US012215712B1

(12) United States Patent
Molnar, Jr. et al.

(10) Patent No.: US 12,215,712 B1
(45) Date of Patent: Feb. 4, 2025

(54) ADJUSTABLE FAN TRACK LINER WITH DUAL GROOVED ARRAY ACTIVE FAN TIP TREATMENT FOR DISTORTION TOLERANCE

(71) Applicants: Rolls-Royce North American Technologies Inc., Indianapolis, IN (US); Rolls-Royce Corporation, Indianapolis, IN (US)

(72) Inventors: Daniel E. Molnar, Jr., Indianapolis, IN (US); Robert W. Heeter, Indianapolis, IN (US); Jonathan M. Rivers, Indianapolis, IN (US)

(73) Assignees: Rolls-Royce North American Technologies Inc., Indianapolis, IN (US); Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 18/660,073

(22) Filed: May 9, 2024

(51) Int. Cl.

| | |
|---|---|
| ***F04D 29/68*** | (2006.01) |
| ***F01D 11/08*** | (2006.01) |
| ***F04D 27/02*** | (2006.01) |
| ***F04D 29/52*** | (2006.01) |

(52) U.S. Cl.
CPC ..... *F04D 29/526* (2013.01); *F01D 11/08* (2013.01); *F04D 27/0246* (2013.01); *F04D 29/685* (2013.01)

(58) Field of Classification Search
CPC ..... F04D 29/685; F04D 29/526; F01D 11/08; F01D 11/22
See application file for complete search history.

(56) References Cited

U.S. PATENT DOCUMENTS

| | | | | |
|---|---|---|---|---|
| 4,086,022 | A | 4/1978 | Freeman et al. | |
| 4,155,680 | A | 5/1979 | Linko, III et al. | |
| 4,239,452 | A | 12/1980 | Frank, Jr. | |
| 5,137,419 | A | 8/1992 | Waterman | |
| 5,308,225 | A | 5/1994 | Koff et al. | |
| 5,474,417 | A | 12/1995 | Privett et al. | |
| 5,762,470 | A | 6/1998 | Gelmedov et al. | |
| 6,231,301 | B1 | 5/2001 | Barnett et al. | |
| 6,406,470 | B1 | 6/2002 | Kierce | |
| 6,497,551 | B1 | 12/2002 | Hand et al. | |
| 6,514,039 | B1 | 2/2003 | Hand | |
| 6,619,909 | B2 | 9/2003 | Barnett et al. | |
| 6,648,591 | B2 | 11/2003 | Collins | |
| 6,685,426 | B2 | 2/2004 | Clark | |
| 6,736,594 | B2 * | 5/2004 | Irie | F04D 29/547 415/173.1 |

(Continued)

FOREIGN PATENT DOCUMENTS

| | | | |
|---|---|---|---|
| CN | 201152282 | Y | 11/2008 |
| CN | 104373388 | B | 1/2017 |

(Continued)

*Primary Examiner* — Woody A Lee, Jr.
*Assistant Examiner* — Behnoush Haghighian
(74) *Attorney, Agent, or Firm* — Barnes & Thornburg LLP

(57) ABSTRACT

A gas turbine engine includes a fan and a fan case assembly. The fan includes a fan rotor configured to rotate about an axis of the gas turbine engine and a plurality of fan blades coupled to the fan rotor for rotation therewith. The fan case assembly extends circumferentially around the plurality of fan blades radially outward of the plurality of the fan blades.

20 Claims, 10 Drawing Sheets

(56) References Cited

U.S. PATENT DOCUMENTS

| | | | | |
|---|---|---|---|---|
| 6,742,983 | B2 | 6/2004 | Schmuecker | |
| 6,832,890 | B2 | 12/2004 | Booth | |
| 6,905,305 | B2 | 6/2005 | James | |
| 6,935,833 | B2 | 8/2005 | Seitz | |
| 7,077,623 | B2 | 7/2006 | Guemmer | |
| 7,186,072 | B2 | 3/2007 | Seitz | |
| 7,210,905 | B2 | 5/2007 | Lapworth | |
| 7,575,412 | B2 | 8/2009 | Seitz | |
| 7,967,556 | B2 | 6/2011 | Volker | |
| 8,043,046 | B2 | 10/2011 | Guemmer | |
| 8,152,444 | B2 | 4/2012 | Guemmer | |
| 8,152,445 | B2 | 4/2012 | Guemmer | |
| 8,152,467 | B2 | 4/2012 | Guemmer | |
| 8,182,209 | B2 | 5/2012 | Brault et al. | |
| 8,192,148 | B2 | 6/2012 | Guemmer | |
| 8,257,022 | B2 | 9/2012 | Guemmer | |
| 8,262,340 | B2 | 9/2012 | Guemmer | |
| 8,337,146 | B2 | 12/2012 | Yu | |
| 8,403,630 | B2 | 3/2013 | Guemmer | |
| 8,419,355 | B2 | 4/2013 | Guemmer et al. | |
| 8,602,720 | B2 | 12/2013 | Goswami et al. | |
| 8,845,269 | B2 | 9/2014 | Agneray et al. | |
| 8,915,699 | B2 | 12/2014 | Brignole et al. | |
| 9,638,213 | B2 | 5/2017 | Obrecht et al. | |
| 9,651,060 | B2 | 5/2017 | Morel et al. | |
| 9,816,528 | B2 | 11/2017 | Johann | |
| 9,957,976 | B2 | 5/2018 | Allford | |
| 10,024,336 | B2 | 7/2018 | Obrecht et al. | |
| 10,047,620 | B2 | 8/2018 | Giacchéet al. | |
| 10,066,640 | B2 | 9/2018 | Bennington et al. | |
| 10,378,550 | B2 * | 8/2019 | Lim | F04D 29/685 |
| 10,450,869 | B2 | 10/2019 | Brignole et al. | |
| 10,539,154 | B2 | 1/2020 | Mallina et al. | |
| 10,914,318 | B2 | 2/2021 | Capozzi et al. | |
| 11,078,805 | B2 | 8/2021 | Joly et al. | |
| 11,092,030 | B2 * | 8/2021 | Joly | F04D 29/685 |
| 11,131,322 | B2 | 9/2021 | Grothe et al. | |
| 11,473,438 | B2 | 10/2022 | Reynolds et al. | |
| 11,572,897 | B1 * | 2/2023 | Duong | F04D 27/0246 |
| 11,686,207 | B2 | 6/2023 | Brignole et al. | |
| 11,702,945 | B2 | 7/2023 | Heeter et al. | |
| 11,732,612 | B2 | 8/2023 | Molnar, Jr. et al. | |
| 2003/0002982 | A1 * | 1/2003 | Irie | F04D 15/0027 415/220 |
| 2005/0226717 | A1 | 10/2005 | Xu | |
| 2007/0147989 | A1 | 6/2007 | Collins | |
| 2008/0044273 | A1 | 2/2008 | Khalid | |
| 2009/0065064 | A1 | 3/2009 | Morris et al. | |
| 2010/0310353 | A1 | 12/2010 | Yu | |
| 2012/0269619 | A1 | 10/2012 | Johann | |
| 2012/0315131 | A1 * | 12/2012 | Mertens | F04D 27/0215 415/126 |
| 2014/0119883 | A1 | 5/2014 | Kempf | |
| 2015/0086344 | A1 | 3/2015 | Guemmer | |
| 2016/0010652 | A1 * | 1/2016 | Lim | F04D 27/002 415/128 |
| 2016/0230776 | A1 | 8/2016 | Bennington et al. | |
| 2018/0163562 | A1 | 6/2018 | Khare et al. | |
| 2020/0224675 | A1 | 7/2020 | Capozzi et al. | |
| 2020/0332673 | A1 * | 10/2020 | Joly | F01D 9/047 |

FOREIGN PATENT DOCUMENTS

| | | | |
|---|---|---|---|
| CN | 110242616 | A | 9/2019 |
| CN | 113217469 | A | 8/2021 |
| DE | 60201109 | T2 | 10/2004 |
| DE | 102007056953 | A1 | 5/2009 |
| DE | 102011007767 | A1 | 10/2012 |
| DE | 102013210169 | A1 | 12/2014 |
| DE | 102018203304 | A1 | 9/2019 |
| EP | 2268926 | B1 | 8/2011 |
| EP | 2434164 | | 3/2012 |
| EP | 2434164 | A1 | 3/2012 |
| EP | 3081779 | | 10/2016 |
| EP | 3081779 | A1 | 10/2016 |
| EP | 3591237 | A1 | 1/2020 |
| EP | 3006679 | B1 | 9/2023 |
| FR | 3122450 | A1 | 11/2022 |
| GB | 2408546 | A | 6/2005 |
| GB | 2477745 | A | 8/2011 |
| JP | 2003227497 | A | 8/2003 |
| KR | 200930757 | A | 3/2009 |
| KR | 1025867 | B1 | 3/2011 |
| KR | 1387391 | B1 | 4/2014 |
| WO | 2014098276 | A1 | 6/2014 |
| WO | 2022229555 | A2 | 11/2022 |

* cited by examiner

ADJUSTABLE FAN TRACK LINER WITH DUAL GROOVED ARRAY ACTIVE FAN TIP TREATMENT FOR DISTORTION TOLERANCE

STATEMENT REGARDING FEDERALLY SPONSORED RESEARCH OR DEVELOPMENT

Embodiments of the present disclosure were made with government support under Contract No. FA8650-19-D-2063 or FA8650-19-F-2078. The government may have certain rights.

FIELD OF THE DISCLOSURE

The present disclosure relates generally to gas turbine engines, and more specifically to fan assemblies for gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

In embedded gas turbine engine applications, the engine may experience high distortion in the form of pressure gradients and swirl. The pressure and swirl distortions may cause engine stall or other undesirable aeromechanical behavior. The fan of the gas turbine engine may include mitigation systems to reduce or minimize the negative effects of pressure and swirl distortions to improve stall margin of the engine.

SUMMARY

The present disclosure may comprise one or more of the following features and combinations thereof.

A fan case assembly may be adapted for use with a gas turbine engine. The fan case assembly may include a case, a plurality of drums, and a control unit.

In some embodiments, the case may extend circumferentially at least partway about a central axis of the fan case assembly to define an outer boundary of a gas path of the gas turbine engine. The case may be formed to define a channel that extends circumferentially at least partway about the central axis.

In some embodiments, the plurality of drums may be arranged in the channel and spaced circumferentially about the central axis. Each drum of the plurality of drums may include a first groove and a second groove spaced axially along the drum form the first groove that each extend partway into the corresponding drum. Each drum of the plurality of drums may be configured to rotate about a respective drum axis between a closed position, a first open position, and second open position.

In some embodiments, in the closed position, the first groove and the second groove of the corresponding drum may both face away from the gas path so that the outer surface of the corresponding drum cooperates with an inner surface of the case to define the outer boundary of the gas path. In the first open position, the first groove of the corresponding drum may face radially inward towards the gas path while the second groove remains facing away from the gas path. In the second open position, the second groove of the corresponding drum may face radially inward towards the gas path while the first groove remains facing away from the gas path.

In some embodiments, the control unit may be configured to rotate the plurality of drums about the respective drum axis between the closed position, the first open position, and the second open position. In some embodiments, the control unit may be configured to rotate the plurality of drums about the respective drum axis between the closed position, the first open position, and the second open position in response to preselected operating conditions to minimize negative effects pressure and swirl distortions in the gas turbine engine to improve stall margin.

In some embodiments, the first groove may be disposed closer to a first axial end of the drum that the second groove. The second groove may be disposed closer to a second axial end of the drum than the first groove. The second axial end may be opposite from the first axial end.

In some embodiments, the first groove may be disposed closer to a leading edge of a fan blade that the second groove. The second groove may be disposed closer to a trailing edge of the fan blade than the first groove.

In some embodiments, the first groove may extend through the corresponding drum at a first angle relative to the gas path. The second groove may extend through the corresponding drum at a second angle relative to the gas path. The second angle may be different from the first angle.

In some embodiments, the plurality of drums may include a first set of drums and a second set of drums. The control unit may be configured to rotate the first set of drums between the closed position, the first open position, and the second open position independent of the second set of drums. In some embodiments, the first set of drums may be alternated circumferentially between the second set of drums.

In some embodiments, at least one of the first groove or the second groove on each respective drum of the first set of drums may have a first depth. At least one of the first groove or the second groove on each respective drum of the second set of drums may have a second depth. The first depth may be greater than the second depth.

In some embodiments, each drum of the plurality of drums may have a cylindrical shape that defines a first end, a second end spaced apart axially from the first end, and the outer surface that extends axially between the first end and the second end and circumferentially about the corresponding drum axis.

In some embodiments the outer surface of each drum of the plurality of drums, at an axial position of the second groove, may cooperate with an inner surface of the gas path to define a portion of the outer boundary of the gas path when each drum of the plurality of drums is in the first open position to block fluid communication with the second groove. In some embodiments the outer surface of each drum of the plurality of drums, at an axial position of the first groove, may cooperate with an inner surface of the gas path to define a portion of the outer boundary of the gas path when each drum of the plurality of drums is in the second open position to block fluid communication with the first groove.

In some embodiments, the control unit may include at least one actuator and a controller. The actuator may be coupled to the plurality of drums and configured to drive rotation of the plurality of drums between the closed position, the first open position, and the second open position. The controller may be coupled to the at least one actuator and configured to direct the at least one actuator to move the plurality of drums to the closed position when the gas turbine engine is in a cruise condition included in the preselected operating conditions.

In some embodiments, the control unit further includes a memory coupled to the controller. The memory may include a plurality of preprogrammed aircraft maneuvers that each correspond to one of the closed position, the first open position, and the second open position. The controller may be configured to detect a preprogrammed aircraft maneuver included in the plurality of preprogrammed aircraft maneuvers on the memory and may direct the at least one actuator to move the plurality of drums to a corresponding position in response to detecting the preprogrammed aircraft maneuver.

In some embodiments, the control unit may include at least one sensor coupled to the controller. The sensor may be configured to measure one of pressure, air speed, altitude, blade tip timing, blade rotational speed, attitude, and acceleration. The controller may be configured to receive a measurement from the at least one sensor and may direct the at least one actuator to move the plurality of drums to a corresponding position in response to the measurement of the at least one sensor.

According to another aspect of the present disclosure, the gas turbine engine may include a fan and a fan case assembly. The fan may include a fan rotor and a plurality of fan blades. The fan may be configured to rotate about an axis of the gas turbine engine. The plurality of fan blades may be coupled to the fan rotor for rotation therewith.

In some embodiments, the fan case assembly may be adapted for use with a gas turbine engine. The fan case assembly may include a case, a plurality of drums, and a control unit.

In some embodiments, the case may extend circumferentially at least partway about a central axis of the fan case assembly to define an outer boundary of a gas path of the gas turbine engine. The case may be formed to define a channel that extends circumferentially at least partway about the central axis.

In some embodiments, the plurality of drums may be arranged in the channel of the case. Each drum of the plurality of drums may include a first groove and a second groove. The second groove may be spaced apart axially from the first groove. The first and second groove may each extend partway into the corresponding drum. In some embodiments, each drum of the plurality of drums may be configured to rotate about a respective drum axis between a closed position and an open position.

In some embodiments, in the closed position, both the first groove and the second groove of the corresponding drum may each face away from the gas path. In the open position, one of the first groove and the second groove of the corresponding drum may face radially inward towards the gas path while the other of the first groove and the second groove may remain facing away from the gas path, and In some embodiments, the control unit may be configured to rotate the plurality of drums about the respective drum axis between the closed position and the open position. In some embodiments, the control unit may be configured to rotate the plurality of drums about the respective drum axis between the closed position and the open position in response to preselected operating conditions.

In some embodiments, the first groove may be disposed closer to a first axial end of the drum that the second groove. The second groove may be disposed closer to a second axial end of the drum than the first groove. The second axial end may be opposite from the first axial end.

In some embodiments, each drum of the plurality of drums may have a cylindrical shape that defines a first end, a second end spaced apart axially from the first end, and an outer surface that extends axially between the first end and the second end and circumferentially about the corresponding drum axis. The outer surface of each drum of the plurality of drums may cooperate with an inner surface of the gas path to define a portion of the outer boundary of the gas path when each drum of the plurality of drums is in the closed position.

In some embodiments, the plurality of drums may include a first set of drums and a second set of drums. The control unit may be configured to rotate the first set of drums between the closed position and the open position independent of the second set of drums. In some embodiments, the first set of drums may be alternated circumferentially between the second set of drums.

In some embodiments, the control unit may include at least one actuator coupled to the plurality of drums and a controller. The actuator may be configured to drive movement of the plurality of drums between the closed position and the open position. The controller may be coupled to the at least one actuator and may be configured to direct the at least one actuator to move the plurality of drums to the closed position when the gas turbine engine is in a cruise condition included in the preselected operating conditions.

According to another aspect of the present disclosure, a method may include providing a fan case assembly. The fan case assembly may be adapted for use with a gas turbine engine.

In some embodiments, the fan case assembly may include a case and a plurality of drums. The case may extend circumferentially at least partway about a central axis of the gas turbine engine and may be formed to define an outer boundary of a gas path of the gas turbine engine. The case may be formed to define a channel that extends circumferentially at least partway about the central axis.

In some embodiments, the plurality of drums may arranged in the channel. Each one of the plurality of drums may include a first groove and a second groove. The first groove and the second groove may each extend partway into the drum. Each drum of the plurality of drums may be configured to rotate about a respective drum axis.

In some embodiments, the method may include locating the plurality of drums in a closed position. In the closed position, the first groove and the second groove of the corresponding drum may face away from the gas path to cause the outer surface of the corresponding drum to cooperate with an inner surface of the case to define the outer boundary of the gas path.

In some embodiments, the method may include rotating the plurality of drums to an open position. In the open position, one of the first groove and the second groove of the corresponding drum may face radially inward towards the gas path while the other of the first groove and the second groove may face away from the gas path.

These and other features of the present disclosure will become more apparent from the following description of the illustrative embodiments.

DETAILED DESCRIPTION OF THE DRAWINGS

Figure 1:
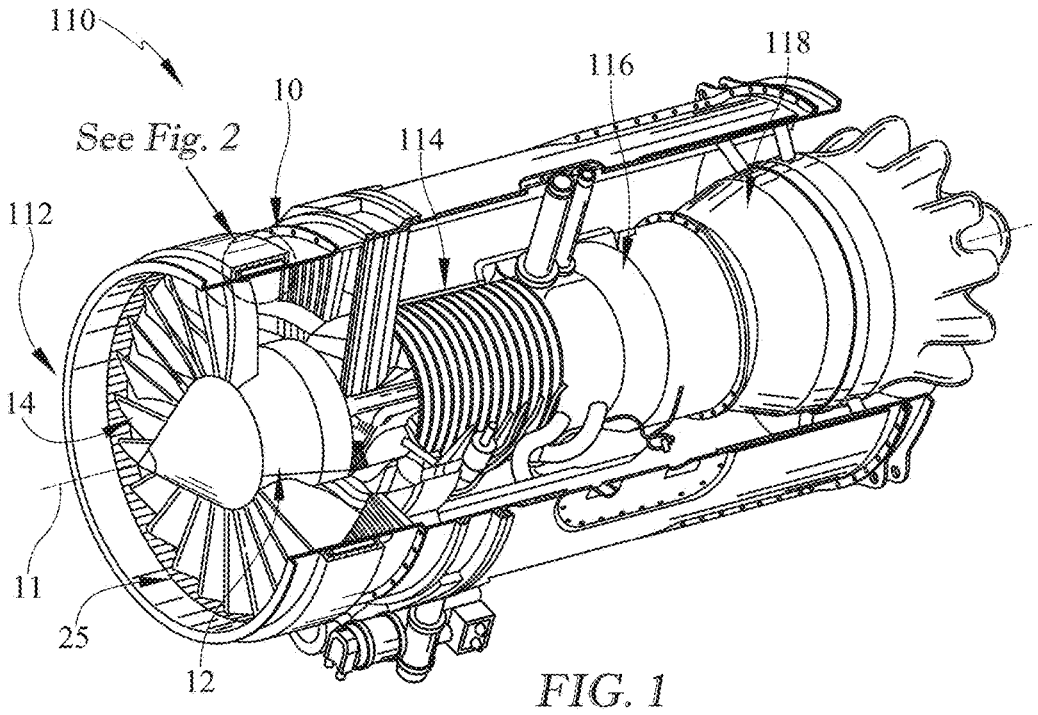
FIG. 1 is a cutaway view of a gas turbine engine that includes a fan, a compressor, a combustor, and a turbine, the fan including fan rotor configured to rotate about an axis of the engine and a fan case assembly that surrounds fan blades included in the fan rotor.

For the purposes of promoting an understanding of the principles of the disclosure, reference will now be made to a number of illustrative embodiments illustrated in the drawings and specific language will be used to describe the same.

A fan case assembly 10 is adapted for use in a gas turbine engine 110 as shown in FIG. 1. The gas turbine engine 110 includes a fan 112, a compressor 114, a combustor 116, and a turbine 118 as shown in FIG. 1. The fan 112 is driven by the turbine 118 and provides thrust for propelling an aircraft. The compressor 114 compresses and delivers air to the combustor 116. The combustor 116 mixes fuel with the compressed air received from the compressor 114 and ignites the fuel. The hot, high pressure products of the combustion reaction in the combustor 116 are directed into the turbine 118 to cause the turbine 118 to rotate about a central axis 11 of the gas turbine engine 110 and drive the compressor 114 and the fan 112.

The fan 112 includes a fan rotor 12 and a fan case assembly 10 as shown in FIG. 1. The fan rotor 12 has a number of fan blades 14. The fan case assembly 10 extends circumferentially around the fan blades 14 of the fan rotor 12 such that the fan case assembly 10 is aligned axially with the fan blades 14.

Figure 2:
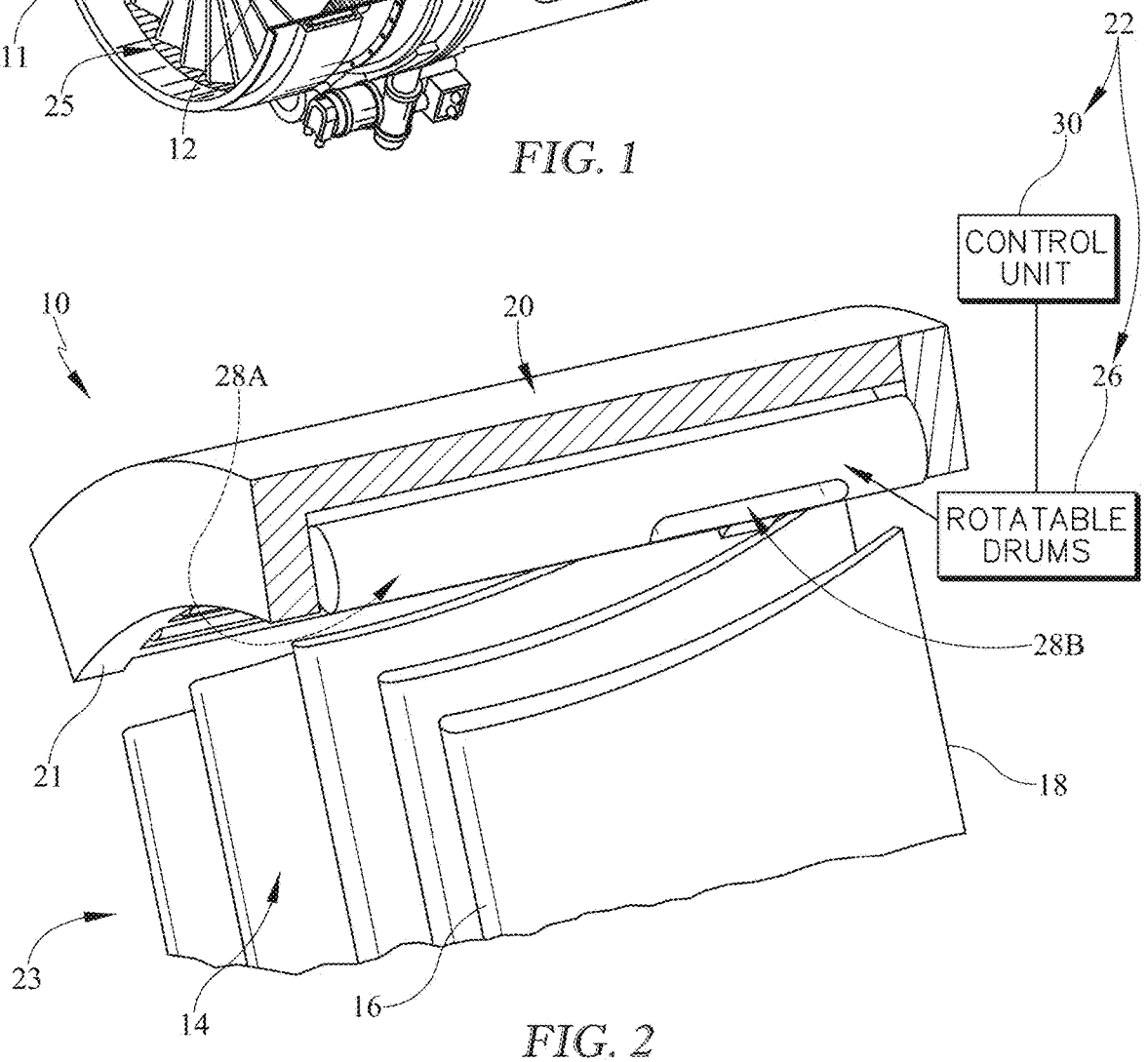
FIG. 2 is a detail view of the fan case assembly included in the gas turbine engine of FIG. 1 showing that the fan case assembly includes a case that extends circumferentially at least partway about a central axis of the engine radially outward of the fan blades to define an outer boundary of a gas path of the gas turbine engine, a plurality of drums arranged in the fan case assembly and configured to rotate about a respective drum axis between a closed position as shown in FIGS. 8A and 8B, a leading edge open position as shown in FIGS. 9A and 9B, and a trailing edge open position as shown in FIGS. 10A and 10B to form recesses in the outer boundary of the gas path to recirculate air at the tips of the fan blades, and a control unit configured to rotate the plurality of drums between the different positions in response to preselected operating conditions to minimize negative effects of pressure and swirl distortions in the gas turbine engine to improve stall margin.
Figure 3:
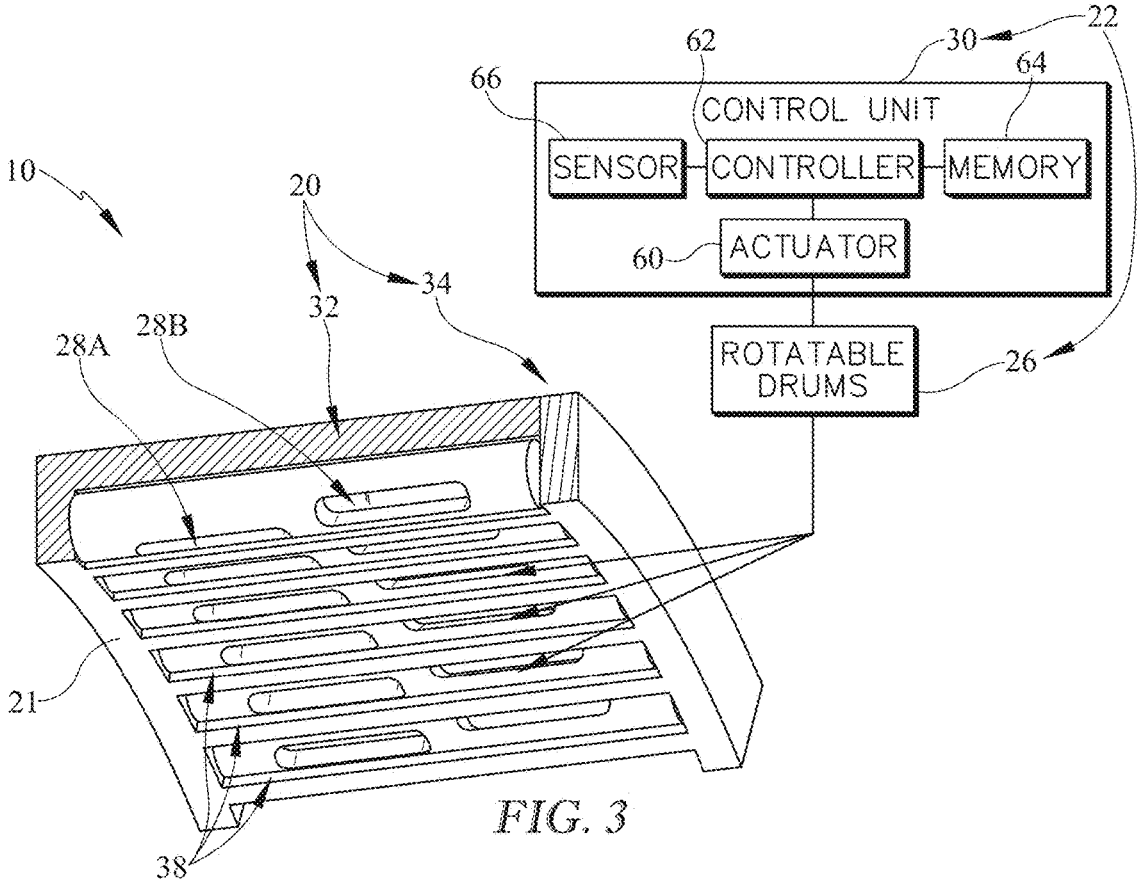
FIG. 3 is a perspective view of the fan case assembly of FIG. 2 showing the plurality of drums are spaced apart circumferentially about the central axis.
Figure 4:
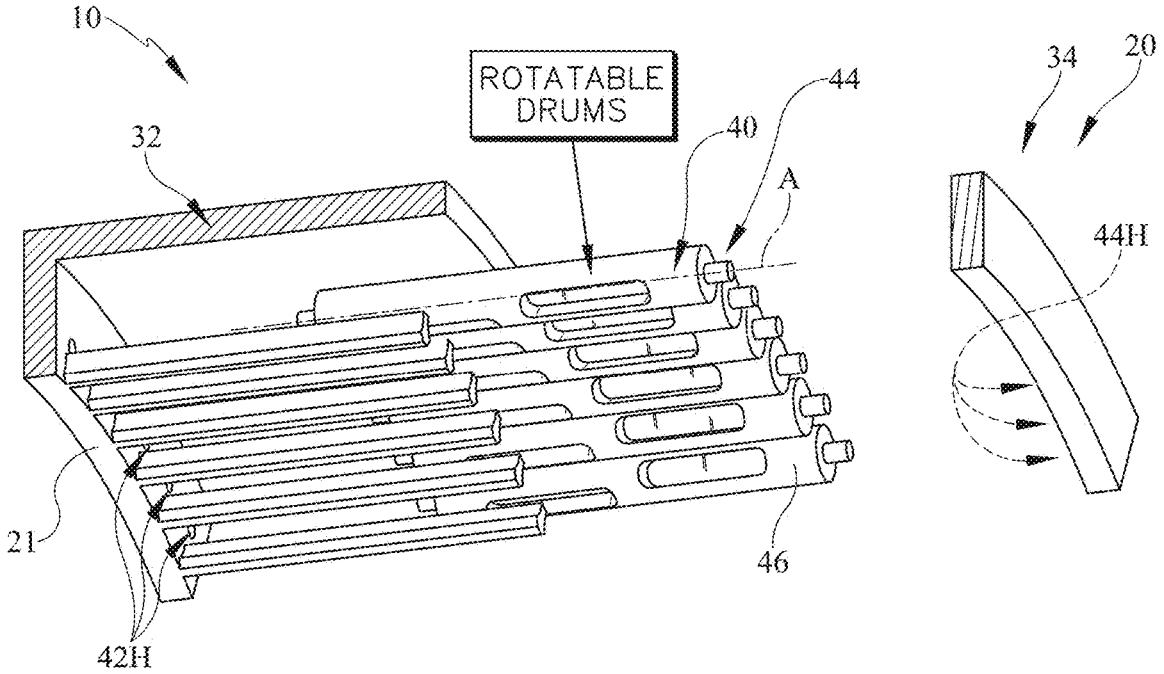
FIG. 4 is an exploded view of FIG. 3 showing the case includes a forward section and an aft section configured to be coupled to the forward section to trap the plurality of drums axially therebetween, and further showing each of the drums includes a drum body that extends axially between opposite axial ends and a pair of pegs that extend axially from the opposite ends of the corresponding drum body to fit into peg holes formed in the forward and aft sections of the case.

The fan case assembly 10 includes, among other components, a case 20 and an inlet distortion mitigation system 22 as shown in FIGS. 2-4. The case 20 extends circumferentially at least partway about the central axis 11 to define an outer boundary of a gas path 25 of the gas turbine engine 110. The inlet distortion mitigation system 22 is configured to control whether tip treatment is applied to the fan blades 14 of the fan 112 by altering the shape and/or surface geometry of an inner surface 21 of the case 20 which defines the outer boundary of the gas path 25 of the gas turbine engine 110.

The inlet distortion mitigation system 22 includes a plurality of rotatable drums 26 arranged in the case 20 and a control unit 30 as shown in FIGS. 2-4. The plurality of drums 26 are each rotatably coupled to the case 20 to rotate about a drum axis A. Each drum 26 of the plurality of drums 26 includes a leading edge groove 28A and a trailing edge groove 28B that each extend radially partway into the corresponding drum 26 relative to the drum axis A. The grooves 28A, 28B extend axially partway along the drums 26 relative to the drum axis A. The leading edge groove 28A is closer in proximity to a leading edge 16 of the fan blades 14 and the trailing edge groove 28B is closer in proximity to a trailing edge 18 of the fan blades.

In illustrative embodiments, the leading edge groove 28A extends axially between an end of the corresponding drum 26 closest to the leading edge 16 of the fan blades 14 and an axially midpoint of the drum 26. In illustrative embodiments, the trailing edge groove 28B extends axially between an end of the corresponding drum 26 closest to the trailing edge 18 of the fan blades 14 and the axially midpoint of the drum 26. In other illustrative embodiments, the leading edge groove 28A or the trailing edge groove 28B may extend from one end of the corresponding drum 26 past the axial midpoint of the drum 26. In illustrative embodiments, the leading edge groove 28A and the trailing edge groove 28B are the same or substantially the same in axial length. In other illustrative embodiments, the leading edge groove 28A and the trailing edge groove 28B are different lengths.

Figure 5:
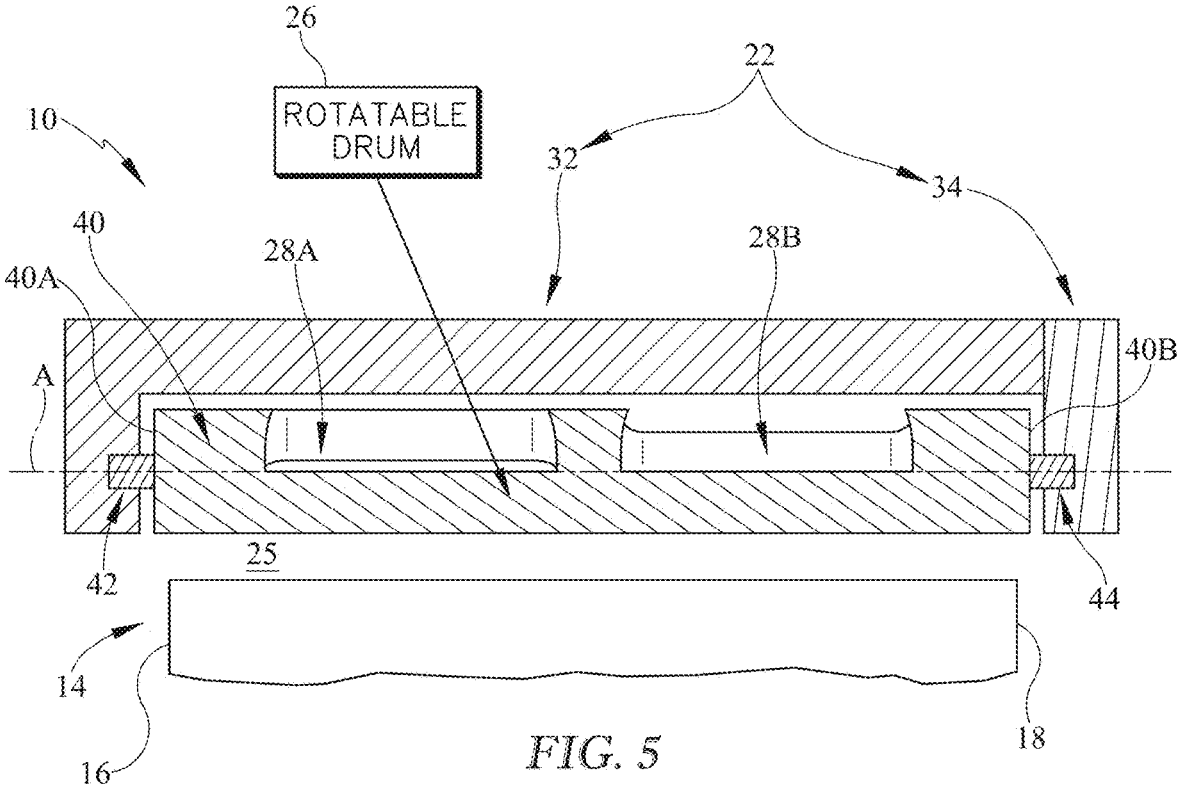
FIG. 5 is a circumferential cross-section view of the fan case assembly of FIG. 3 showing the plurality of drums in the closed position in which both the leading edge groove and the trailing edge groove of the corresponding drum face away from the gas path so that the outer surface of the corresponding drum cooperates with the inner surface of the fan case to form a portion of the outer boundary of the gas path to remove the tip treatment.
Figure 6:
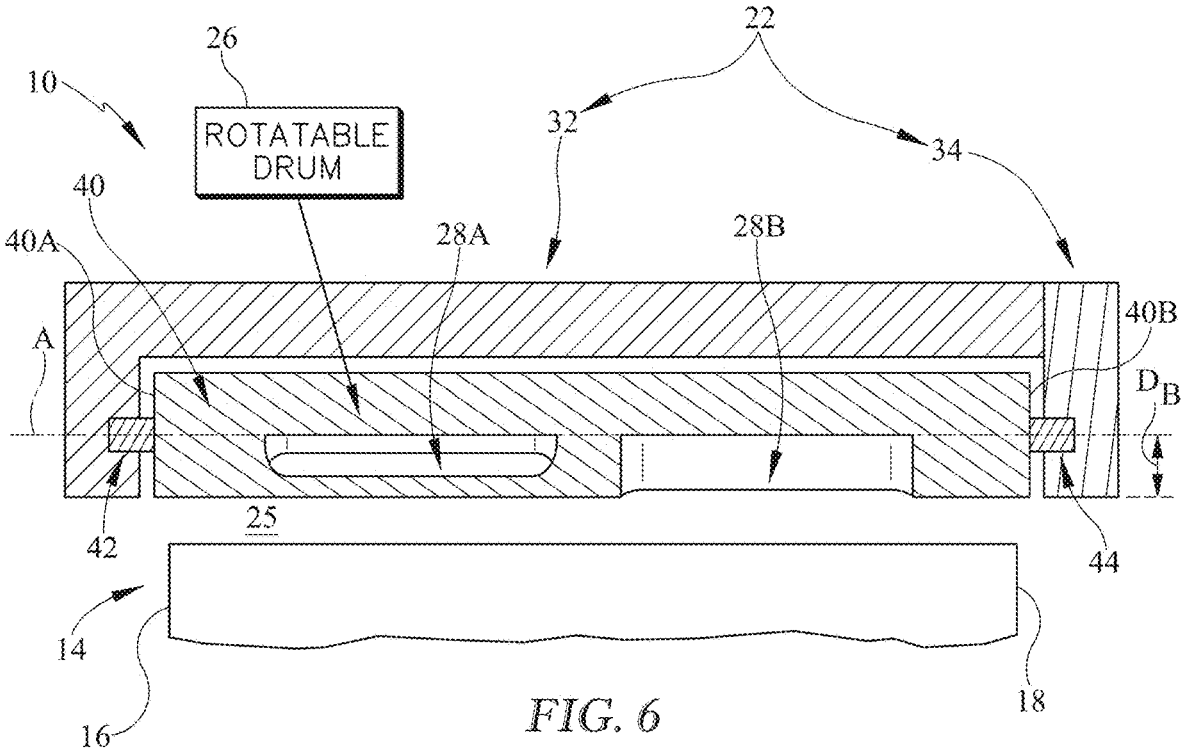
FIG. 6 is a circumferential cross-section view of the fan case assembly of FIG. 3 showing the plurality of drums in the trailing edge open position in which the trailing edge groove of the corresponding drum faces radially inward and opens towards the gas path to allow air form the gas path recirculates air at the tips of the fan blades, and the leading edge groove faces away from the gas path.
Figure 7:
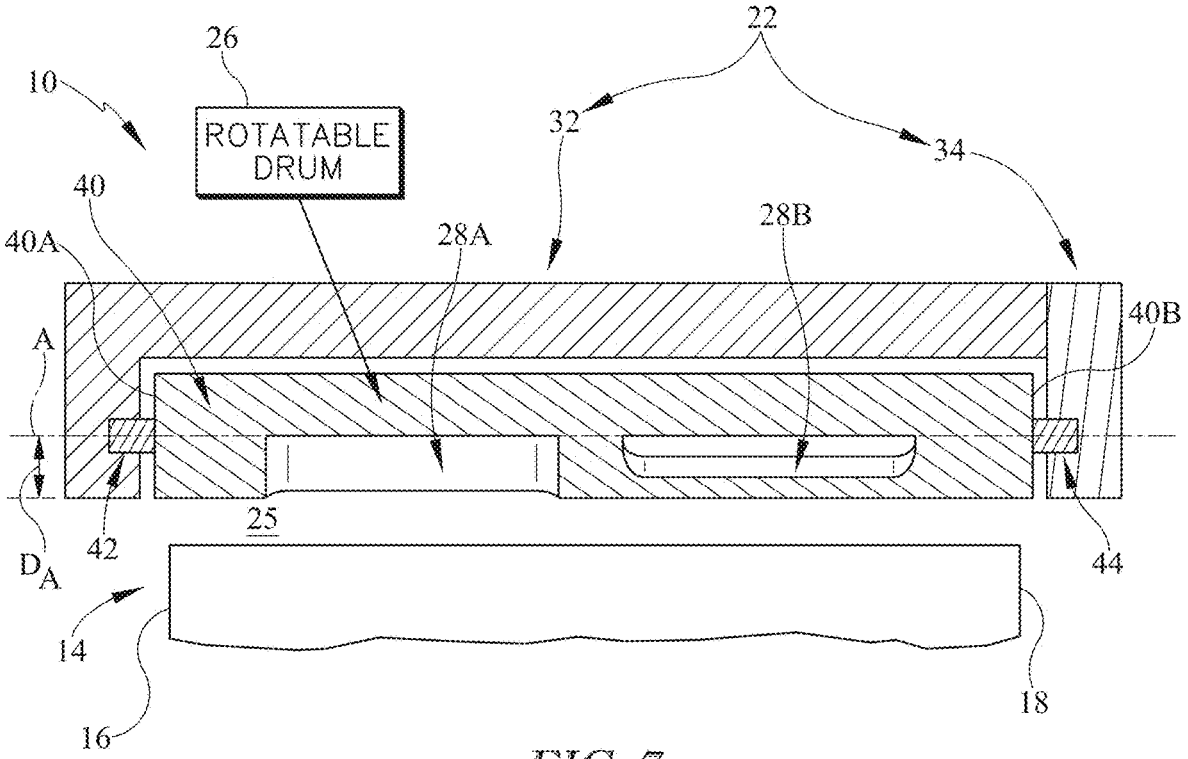
FIG. 7 is a circumferential cross-section view of the fan case assembly of FIG. 3 showing the plurality of drums in the leading edge open position in which the leading edge groove of the corresponding drum faces radially inward and opens towards the gas path to allow air form the gas path recirculates air at the tips of the fan blades, and the trailing edge groove faces away from the gas path.

The leading edge groove 28A extends into the corresponding drum 26 to a certain depth $D_A$ as shown in FIG. 7, and the trailing edge groove 28B extends into the corresponding drum 26 to a certain depth $D_B$ as shown in FIG. 6. In some embodiments, the depths $D_A$, $D_B$ of one or both of the grooves 28A, 28B are substantially equal to a radius of the drum 26 such that the grooves 28A, 28B extend to a midpoint or half of the diameter of the drum 26, as shown in FIGS. 5-7. Alternatively, as described in more detail below, one or both of the grooves 28A, 28B may extend a lesser depth into the drum 26 or may extend a greater depth into the drum 26. In illustrative embodiments, the depth $D_A$ of the leading edge groove 28A is the same or substantially equal to the depth $D_B$ of the trailing edge groove 28B. In other illustrative embodiments, the depth $D_A$ of the leading edge groove 28A is different, for example, deeper or shallower, than the depth $D_B$ of the trailing edge groove 28B.

In the illustrative embodiment, the grooves 28A, 28B extends radially partway into the corresponding drum 26. In some embodiments, one or more of the grooves 28A, 28B may extend radially and circumferentially partway into the corresponding drum 26.

Figure 8A:
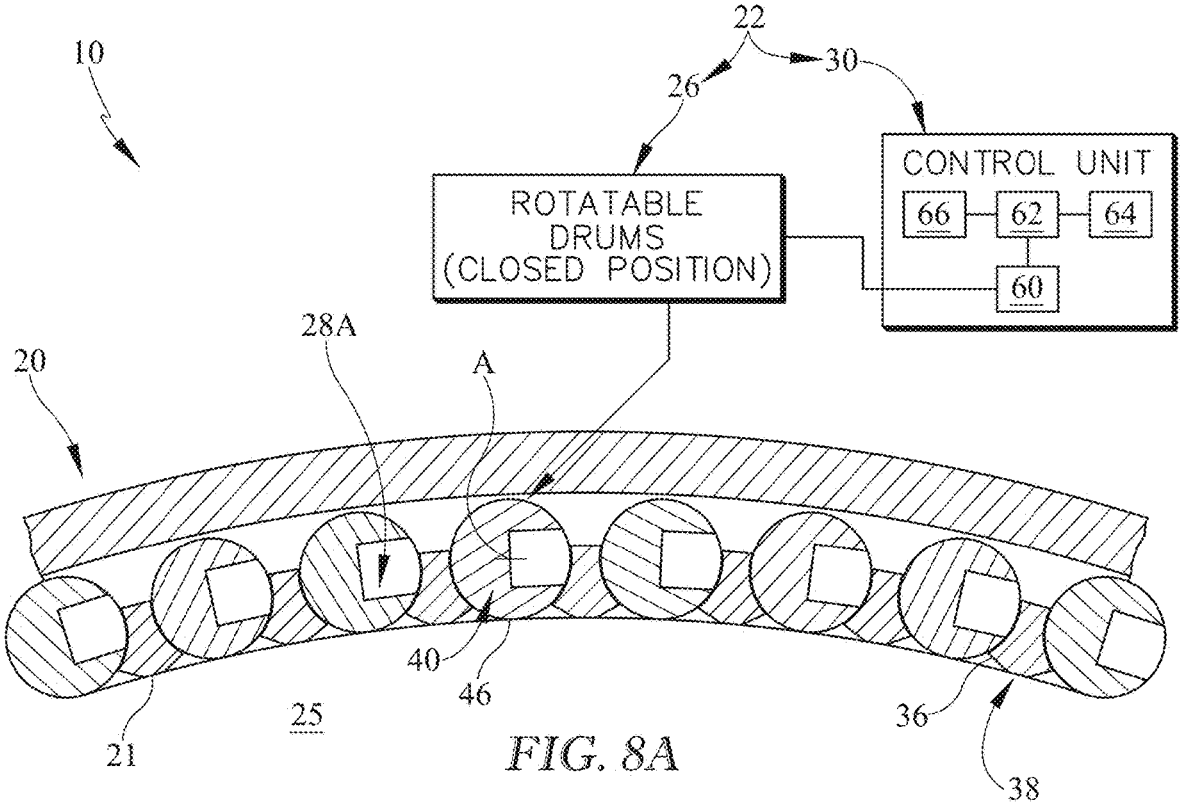
FIG. 8A is an axial cross-section view at the leading edge grooves of fan case assembly of FIG. 3 with the plurality of drums in the closed position in which the leading edge groove of the corresponding drum faces away from the gas path to close off the leading edge groove from the gas path so that the outer surface of the corresponding drum near the leading edge cooperates with the inner surface of the case to define a portion of the outer boundary of the gas path.
Figure 8B:
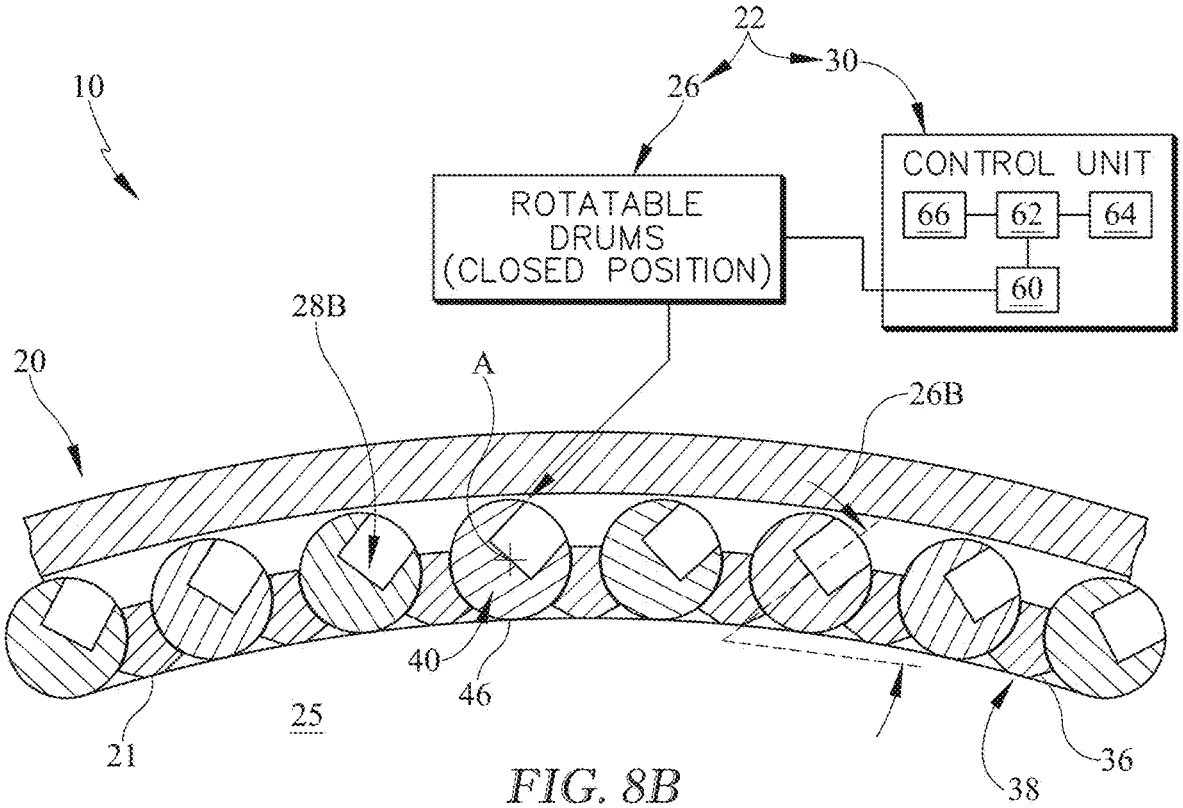
FIG. 8B is an axial cross-section view at the trailing edge grooves of fan case assembly of FIG. 3 with the plurality of drums in the closed position in which the trailing edge groove of the corresponding drum faces away from the gas path to close off the trailing edge groove from the gas path so that the outer surface of the corresponding drum near the trailing edge cooperates with the inner surface of the case to define a portion of the outer boundary of the gas path.
Figure 9A:
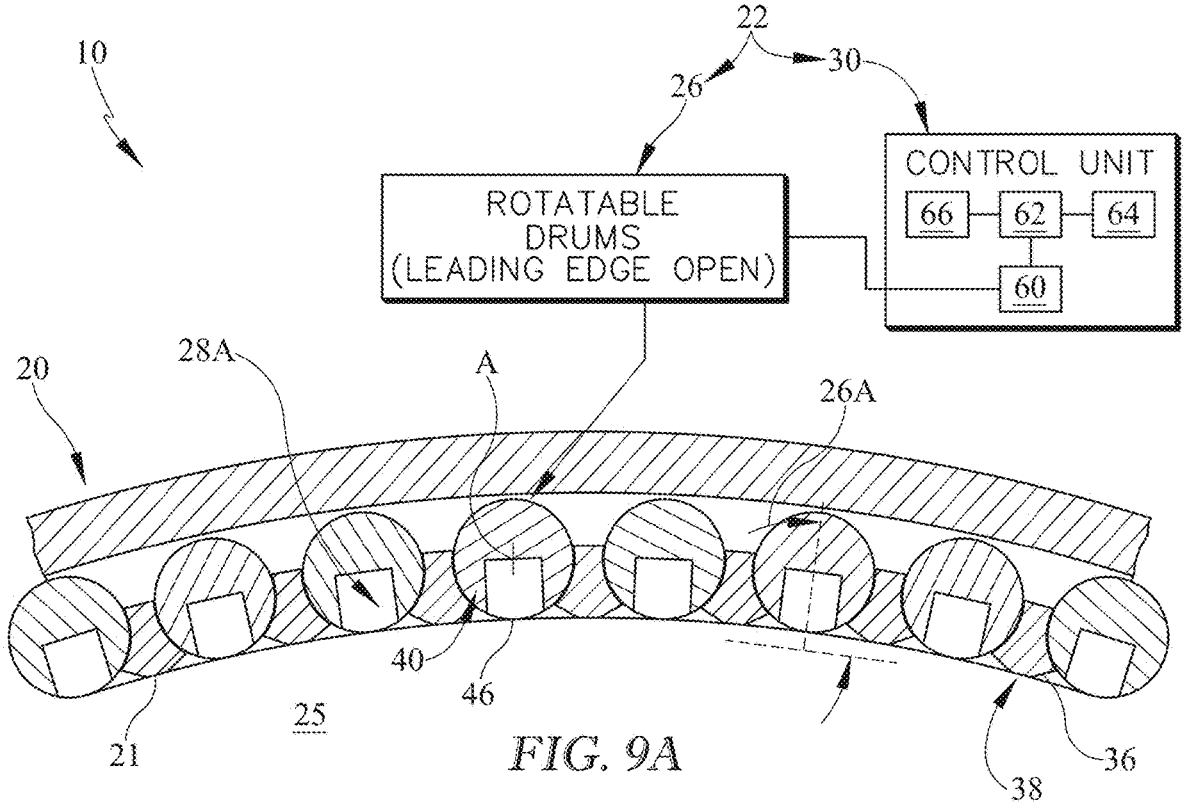
FIG. 9A is an axial cross-section view at the leading edge grooves of fan case assembly of FIG. 3 with the plurality of drums in the leading edge open position in which the leading edge groove of the corresponding drum faces towards the gas path so that the leading edge groove is open to the gas path to allow air to flow into the leading edge groove from the gas path to provide the tip treatment to the fan blades.
Figure 9B:
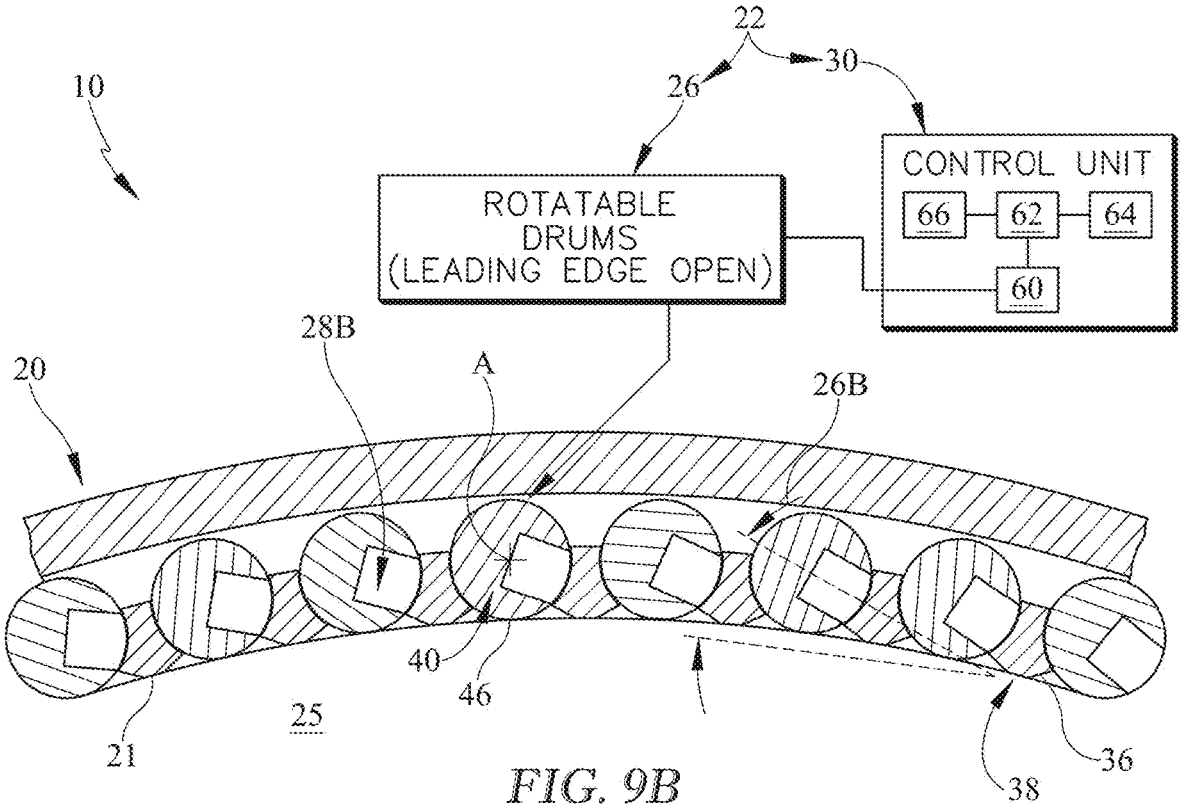
FIG. 9B is an axial cross-section view at the trailing edge grooves of fan case assembly of FIG. 3 with the plurality of drums in the leading edge open position in which the trailing edge groove of the corresponding drum faces away from the gas path to close off the trailing edge groove from the gas path so that the outer surface of the corresponding drum near the trailing edge cooperates with the inner surface of the case to define a portion of the outer boundary of the gas path.
Figure 10A:
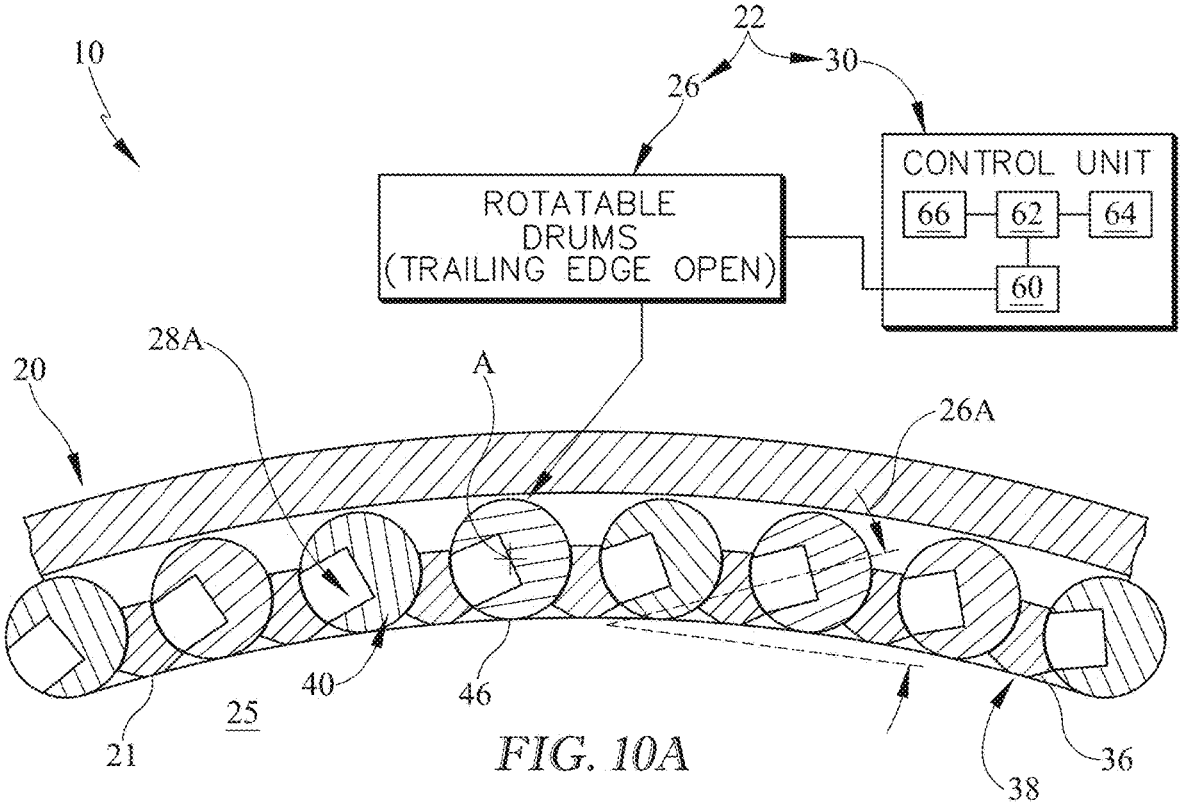
FIG. 10A is an axial cross-section view at the leading edge grooves of fan case assembly of FIG. 3 with the plurality of drums in the trailing edge open position in which the leading edge groove of the corresponding drum faces away from the gas path to close off the leading edge groove from the gas path so that the outer surface of the corresponding drum near the leading edge cooperates with the inner surface of the case to define a portion of the outer boundary of the gas path.
Figure 10B:
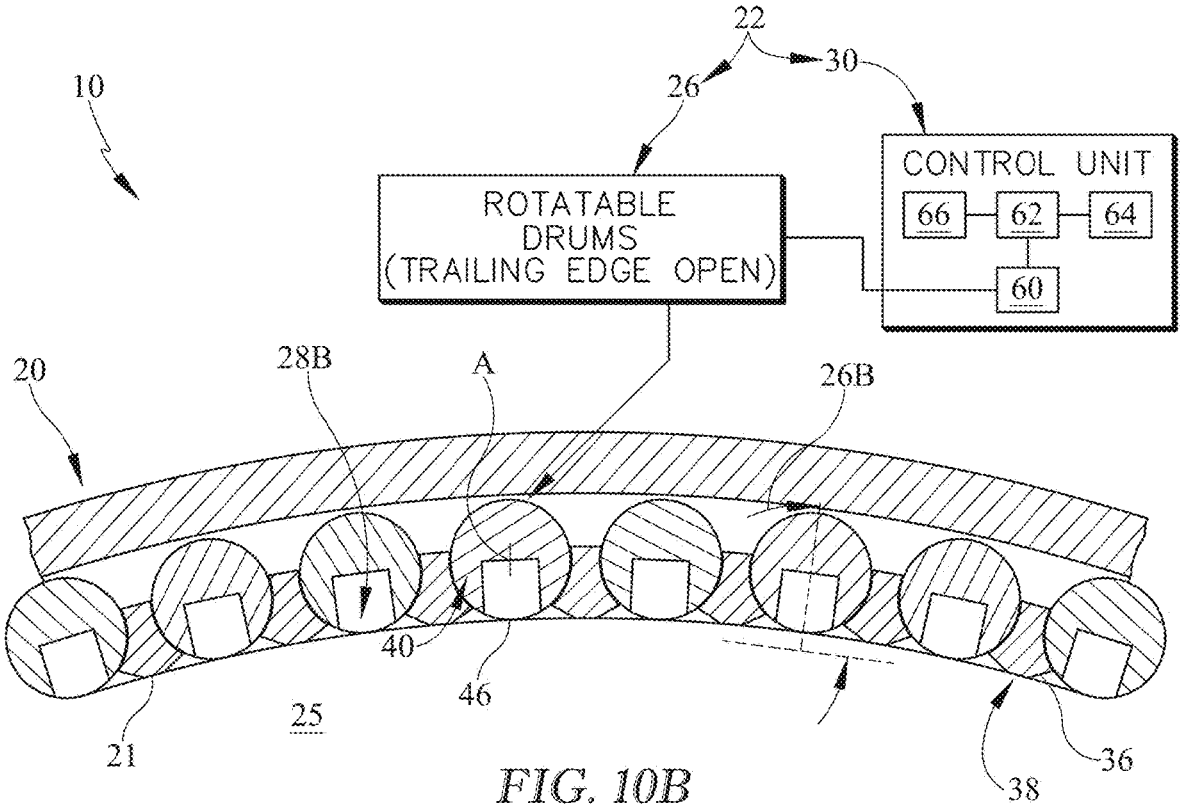
FIG. 10B is an axial cross-section view at the trailing edge grooves of fan case assembly of FIG. 3 with the plurality of drums in the trailing edge open position in which the trailing edge groove of the corresponding drum faces towards the gas path so that the trailing edge groove is open to the gas path to allow air to flow into the trailing edge groove from the gas path to provide the tip treatment to the fan blades.

The inlet distortion mitigation system 22 is configured to change between a closed mode as shown in FIGS. 5, 8A, and 8B, a leading edge open mode as shown in FIGS. 7, 9A, and 9B, and a trailing edge open mode as shown in FIGS. 6, 10A, and 10B. In the closed mode, some or all of the drums 26 are in a closed position so that both the corresponding leading edge groove 28A and the trailing edge groove 28B face away from the gas path 25 to prevent fluid communication with the grooves 28A, 28B of the corresponding drums 26. In the leading edge open mode, some or all of the drums 26 are in a leading edge open position so that the corresponding leading edge grooves 28A face toward the gas path 25 to open the leading edge grooves 28A to the gas path 25 and allow fluid communication therewith. In the trailing edge open mode, some or all of the drums 26 are in a trailing edge open position so that the corresponding trailing edge grooves 28B face toward the gas path 25 to open the trailing edge grooves 28B to the gas path 25 and allow fluid communication therewith. In the closed mode, no tip treatment benefit is provided, while in the leading edge open mode and trailing edge open mode, the tip treatment is applied to the fan blades 14.

The plurality of drums 26 are each configured to rotate between the closed position as shown in FIGS. 5, 8A, and 8B, the leading edge open position as shown in FIGS. 7, 9A, and 9B, and the trailing edge open position as shown in FIGS. 6, 10A, and 10B. Each rotatable drum 26 rotates about the drum axis A to open one of more of the grooves 28A, 28B towards the gas path 25. When a groove 28A, 28B faces towards or are open to the gas path 25, air from the gas path 25 is allowed to flow into the groove 28A, 28B to recirculate air locally at the tips of the fan blades 14. To remove tip treatment, each of the rotatable drums 26 rotate to close off the groove 28A, 28B from the gas path 25 so that the drums 26 cooperate with the inner surface 21 of the case 20 to form the outer boundary of the gas path 25.

The control unit 30 is configured to rotate each of the plurality of drums 26 about the corresponding drum axis A between the different positions in response to preselected operating conditions to control tip treatment of the fan blades 14. The control unit 30 is configured to rotate each of the drums 26 to control whether the grooves 28A, 28B in each drum 26 face toward or away from the gas path 25, thereby controlling whether the grooves 28A, 28B are in fluid communication with the gas path 25 to recirculate air at the tips of the fan blades 14. The control unit 30 controls the application of the tip treatment to the fan blades 14 so as to minimize the negative effects of pressure and swirl distortions in the gas turbine engine 110 to improve stall margin for the gas turbine engine 110.

Embedded engines on an aircraft may experience high distortion in the form of pressure gradients and swirl. The pressure and swirl distortions may cause engine stall or other undesirable aeromechanical behavior. Attempting to solve the worst stall condition while maintaining performance over all of the cycles or flight conditions may be difficult and result in compromised efficiency or a limited flight envelope.

Therefore, the fan case assembly 10 includes the inlet distortion mitigation system 22 which includes the plurality of drums 26 that rotate relative to the case 20 to control whether the tip treatment is applied to the fan blades 14 included in the fan 112. In this way, the negative effects of pressure and swirl distortions are minimized to improve stall margin. Compensating for distortion to maintain operability margin may further negatively affect efficiency or performance. The negative effects may include loss of efficiency or overall performance of the engine 110 and/or other negative operating conditions known to one of ordinary skill in the art.

In the closed position, both the leading edge groove 28A and the trailing edge groove 28B of each corresponding closed drum 26 faces away from the gas path 25 so that the outer surface 46 of each drum 26 cooperates with the inner surface 21 of the case 20 to define the outer boundary of the gas path 25 as shown in FIGS. 5, 8A, and 8B. The outer surface 46 of each drum 26 forms a part of the outer boundary of the gas path 25 to form a uniform/consistent inner surface 21 or outer boundary of the gas path 25, i.e. no recesses or discontinuities are formed in the outer boundary of the gas path 25 such that tip treatment is removed. Fluid communication between the gas path 25 and both of the grooves 28A, 28B are blocked when the corresponding drum 26 is in the closed position.

In the illustrative embodiment, the grooves 28A, 28B of the corresponding drum 26 extend away from the gas path 25 when the corresponding drum is in the closed position as shown in FIGS. 8A, 8B, 9B, and 10A. In illustrative embodiments, as shown in FIGS. 8A, the groove 28A extends circumferentially relative to the central axis 11 to face the groove 28A away from the gas path 25 and close off the groove 28A from the gas path 25 when the corresponding drum 26 is in the closed position. Alternatively or additionally, the grooves 28A, 28B may extend at any angle relative to the central axis 11 that prevents the grooves 28A, 28B to from being partially or wholly open to the gas path 25, as shown in FIGS. 8B, 9B, and 10A. The outer surface 46 of each drum 26, at the axially location of the respective groove 28A, 28B, forms a part of the outer boundary of the gas path 25 to block fluid communication between the gas path 25 and the respective groove 28A, 28B when each of the drums 26 are in the closed position. In illustrative embodiments, the drum 26 may be turned 90 degrees or smaller, for example, 60 degrees as long as the groove is not communicating with the flowpath.

A groove 28A, 28B of the corresponding drums 26 faces towards the gas path 25 whenever the groove 28A, 28B is open to the gas path 25 so that fluid communication between the gas path 25 and the groove 28A, 28B is allowed. As shown in FIGS. 9A and 10B, the grooves 28A and 28B, respectively face radially inward toward the gas path 25. In some embodiments, the groove 28A, 28B may extend radially and circumferentially relative to the axis 11, but still remain facing toward the gas path 25 as the groove 28A, 28B are still in fluid communication with the gas path 25.

FIGS. 8A and 8B show the drums 26 at the same, closed position. FIG. 8A shows a cross-section view at the leading edge groove 28A of the drums 26 in the closed position, and FIG. 8B shows a cross-section view at the trailing edge groove 28B of the drums 26 in the same, closed position. In other words, FIG. 8A and FIG. 8B show the same drums 26 in the same closed position, but FIG. 8A shows an axial cross section at a first location along an axis A of the drums 26, and FIG. 8B shows an axial cross section at a second location along the axis A of the drums, axially aft of the first location shown in FIG. 8A.

In the leading edge open position, the leading edge groove 28A of each corresponding open drum 26 faces towards the gas path 25 so that the leading edge groove 28A is open to the gas path 25 to allow air to flow into the leading edge groove 28A from the gas path 25 as shown in FIGS. 7 and 9A. The leading edge groove 28A faces towards the gas path 25 to form a recess in the outer boundary of the gas path 25. In this way, air from the gas path 25 is allowed to flow into the recess in the outer boundary of the gas path 25 created by the leading edge groove 28A to recirculate air at the tips of the fan blades 14.

In the leading edge open position, the leading edge groove 28A of each corresponding open drum 26 extends radially relative to the central axis 11 to open the leading edge groove 28A to the gas path 25 to allow fluid communication between the gas path 25 and the leading edge groove 28A as shown in FIGS. 7 and 9A. In other words, in the leading edge open position, the leading edge groove 28A extends perpendicular to or at a 90° angle to the inner surface 21 of the case 20.

Additionally, in the leading edge open position, the trailing edge groove 28B of each corresponding closed drum 26 is closed off from the gas path 25 to block fluid communication between the gas path 25 and the trailing edge groove 28B, as shown in FIGS. 7 and 9B. In other words, in the leading edge open position, a portion of the outer surface 46 of each of the closed drums 26 at an axial location of the trailing edge groove 28B cooperates with an inner surface 21 of the case 20 to define the outer boundary of the gas path 25. The outer surface 46 of each drum 26 at an axial location of the trailing edge groove 28B forms a part of the outer boundary of the gas path 25 thereby covering any opening near the trailing edge 18 of the fan blades 14 to block fluid communication between the gas path 25 and the trailing edge groove 28B near the trailing edge 18 of the fan blades 14 when each of the drums 26 are in the leading edge open position.

FIGS. 9A and 9B show the drums 26 at the same, leading edge open position. FIG. 9A shows a cross-section view at the leading edge groove 28A of the drums 26 in the leading edge open position, and FIG. 9B shows a cross-section view at the trailing edge groove 28B of the drums 26 in the same, leading edge open position. In other words, FIG. 9A and FIG. 9B show the same drums 26 in the same leading edge open position, but FIG. 9A shows an axial cross section at a first location along an axis A of the drums 26, and FIG. 9B shows an axial cross section at a second location along the axis A of the drums, axially aft of the first location shown in FIG. 9A.

In the trailing edge open position, the trailing edge groove 28B of each corresponding open drum 26 faces towards the gas path 25 so that the trailing edge groove 28B is open to the gas path 25 to allow air to flow into the trailing edge groove 28B from the gas path 25 as shown in FIGS. 6 and 10B. The trailing edge groove 28B faces towards the gas path 25 to form a recess in the outer boundary of the gas path 25. In this way, air from the gas path 25 is allowed to flow into the recess in the outer boundary of the gas path 25 created by the trailing edge groove 28B to recirculate air at the tips of the fan blades 14.

In the trailing edge open position, the trailing edge groove 28B of each corresponding open drum 26 extends radially relative to the central axis 11 to open the trailing edge groove 28B to the gas path 25 to allow fluid communication between the gas path 25 and the trailing edge groove 28B as shown in FIGS. 6 and 10B. In other words, in the trailing edge open position, the trailing edge groove 28B extends perpendicular to or at a 90° angle to the inner surface 21 of the case 20.

Additionally, in the trailing edge open position, the leading edge groove 28A of each corresponding closed drum 26 is closed off from the gas path 25 to block fluid communication between the gas path 25 and the leading edge groove 28A, as shown in FIGS. 6 and 10A. In other words, in the trailing edge open position, a portion of the outer surface 46 of each of the closed drums 26 at an axial location of the leading edge groove 28A cooperates with an inner surface 21 of the case 20 to define the outer boundary of the gas path 25. The outer surface 46 of each drum 26 at an axial location of the leading edge groove 28A forms a part of the outer boundary of the gas path 25 thereby covering any opening near the leading edge 16 of the fan blades 14 to block fluid communication between the gas path 25 and the leading edge groove 28A near the leading edge 16 of the fan blades 14 when each of the drums 26 are in the trailing edge open position.

FIGS. 10A and 10B show the drums 26 at the same, trailing edge open position. FIG. 10A shows a cross-section view at the leading edge groove 28A of the drums 26 in the trailing edge open position, and FIG. 10B shows a cross-section view at the trailing edge groove 28B of the drums 26 in the same, trailing edge open position. In other words, FIG. 10A and FIG. 10B show the same drums 26 in the same leading edge open position, but FIG. 10A shows an axial cross section at a first location along an axis A of the drums 26, and FIG. 10B shows an axial cross section at a second location along the axis A of the drums, axially aft of the first location shown in FIG. 10A.

The control unit 30 is configured to rotate the drums 26 between the different positions in response to preselected operating conditions. The preselected operating conditions include a plurality of preprogrammed aircraft maneuvers stored on a memory 64 included in the control unit 30. The plurality of preprogrammed aircraft maneuvers include banks, turns, rolls, etc.

The control unit 30 is configured to detect a preprogrammed aircraft maneuver included in the plurality of preprogrammed aircraft maneuvers on the memory 64. Once the preprogrammed aircraft maneuver is detected, the control unit 30 directs each of the drums 26 to rotate to a corresponding position in response to detecting the preprogrammed aircraft maneuver.

For example, the plurality of drums 26 may normally be in the closed position during a cruise condition so that no additional stall margin is created, but performance is not compromised. The cruise condition included in the preselected operating conditions corresponds to when the aircraft is in the cruise portion of the flight cycle.

Then, when the control unit 30 detects a preprogrammed aircraft maneuver, i.e. banks, turns, rolls, the control unit 30 directs the drums 26 to rotate to the leading edge open position or the trailing edge open position so that the leading edge groove 28A or trailing edge groove 28B, respectively, faces toward the gas path 25 and flow is permitted into the leading edge groove 28A or trailing edge groove 28B. The grooves 28A, 28B allow for air to recirculate at the tips of the fan blades 14.

Conversely, when the control unit 30 detects the cruise condition after a preprogrammed aircraft maneuver, the control unit 30 may be configured to direct the drums 26 to rotate to the closed position. Therefore, once the aircraft maneuver is completed, the drums 26 rotate to the closed position to remove the recesses created in the outer boundary of the gas path 25 so that performance is not compromised and the additional stall margin is removed during the cruise condition.

The control unit 30 is configured to direct some or all of the drums 26 to rotate from the closed position to the leading edge open position or the trailing edge open position based on the detected preprogrammed aircraft maneuver. Depending on the preprogrammed aircraft maneuver, the control unit 30 may direct only certain drums 26 to move to the leading edge or trailing edge open position, while keeping others in the closed position.

The preselected operating conditions may further include a sensor input from at least one sensor 66 included in the control unit 30. The sensor 66 is configured to measure one of pressure, air speed, altitude, blade tip timing, blade rotational speed, attitude or aircraft orientation, and acceleration. In some embodiments, the control unit 30 includes a plurality of sensors 66 each configured to measure one of pressure, air speed, altitude, blade tip timing, blade rotational speed, attitude or aircraft orientation, and acceleration.

The control unit 30 is configured to receive a measurement from the at least one sensor 66 or sensors 66 and direct the drums 26 to rotate to a corresponding position in response to the measurement of the at least one sensor 66. The control unit 30 may be configured to rotate the drums 26 to be in the closed position when the measurements from the sensor 66 are within a predetermined threshold.

Then, when the measurement from the sensor 66 is outside of the predetermined threshold, the control unit 30 directs the drums 26 to rotate to the leading edge open position or the trailing edge open position. Based on the difference of the measurement from the sensor 66 compared to the predetermined threshold, the control unit 30 may vary the position of the drums 26 to control whether tip treatment is applied to the fan blades 14 of the fan 112. The control unit 30 may rotate certain drums 26 located circumferentially about the fan 112 to apply tip treatment at different areas around the fan 112. For example, the control unit 30 may direct certain drums 26 to be in leading edge open position or the trailing edge open position to open the leading edge grooves 28A or the trailing edge grooves 28B of the corresponding drums 26 to the gas path 25 to allow air recirculation at that circumferential location about the fan 112.

The control unit 30 is configured to direct some or all of the drums 26 to rotate from the closed position to the leading edge open position or the trailing edge open position based on the measurement from the sensor 66. The control unit 30 may direct some of the drums 26 to remain in the closed position, while directing some of the drums 26 to rotate to the leading edge open position or the trailing edge open position based on the measurement from the sensor 66.

In some embodiments, the control unit 30 may be configured to use a combination of the sensor measurements and the detected preprogrammed aircraft maneuver to control the position of the plurality of drums 26. For example, when the control unit 30 detects a preprogrammed aircraft maneuver and the measurement is outside of the predetermined threshold, the control unit 30 directs some or all of the drums 26 to rotate to the leading edge open position or the trailing edge open position. The control unit 30 is configured to individual vary the angle of the leading edge groove 28A and/or the trailing edge groove 28B of each of the drums 26.

In some embodiments, the control unit 30 is configured to use the measurements from the sensor 66 to anticipate the aircraft maneuver. The control unit 30 is configured to direct some or all of the plurality of drums 26 to move to the leading edge open position or the trailing edge open position in response to the measurement from the sensor 66 even though no preprogrammed aircraft maneuver is detected.

Alternatively, there may be a delay in the measurements from the sensor 66. Therefore, the control unit 30 is also configured to direct some or all of the drums 26 to move to the leading edge open position or the trailing edge open position when the one of the preprogrammed aircraft maneuvers is detected, even though the measurements from the sensor 66 are within the predetermined thresholds.

In some embodiments, the control unit 30 may detect one of the preprogrammed aircraft maneuvers, but the measurements from the sensors 66 are within the predetermined threshold. If so, the control unit 30 may direct some or all of the drums 26 to remain in the current position.

In some embodiments, the inlet distortion mitigation system 22 may utilize a machine learning algorithm. The machine learning algorithm may track inputs, for example, aircraft speed, orientation, altitude, and/or fan speed versus a fan response, as well positioning of the drums 26, and learn how to move the inlet distortion mitigation system 22 to minimize stall margin loss. The mitigation system 22 may utilize the machine learning algorithm to gather data collected from the sensors 66 and/or other systems integrated with the engine 110 and evaluate the data, for example, to learn the correlation between certain environmental factors and/or inputs and stall margin. The algorithm may determine and learn how to minimize stall margin loss based on evaluation of the data collected, and be used by the system 22 to anticipate unfavorable conditions and better control the drums 26 to mitigate stall margin loss.

Turning again to the fan case assembly 10, the fan case assembly 10 extends circumferentially at least partway about the central axis 11 in the illustrative embodiment. In some embodiments, the fan 112 may include multiple fan case assemblies 10 arranged circumferentially about the axis 11 to form a full hoop. In other embodiments, the fan case assembly 10 may be annular and extends circumferentially about the axis 11. In some embodiments, the fan 112 may include multiple fan case assemblies 10 spaced apart circumferentially about the axis 11 to define segments between each fan case assembly 10.

The case 20 includes a forward section 32 and an aft section 34 as shown in FIG. 4. The aft section 34 is configured to be coupled to the forward section 32 to trap the plurality of drums 26 axially therebetween.

In the illustrative embodiment, the drums 26 are positioned in the case 20 so that the drums 26 extend axially across the tips of the fan blades 14 between a leading edge 16 and a trailing edge 18 of the fan blades 14 as shown in FIGS. 2 and 5-7. Each drum 26 extends axially across the tips of the fan blades 14. The grooves 28A, 28B of each drum 26 extends axially along a portion of the axial length of the drum 26, between the leading edge 16 and the trailing edge 18 in the illustrative embodiment. In some embodiments, at least one of the grooves 28A, 28B may extend forward of the leading edge 16 and/or at least one of the grooves 28A, 28B may extend aft of the trailing edge 18.

In the illustrative embodiment, the grooves 28A, 28B have a rectangular cross-sectional shape as shown in FIGS. 5-12B. In some embodiments, the grooves 28A, 28B may have a forward-leaning or curved cross-sectional shape. In some embodiments, the grooves 28A, 28B may have another cross-sectional shape.

In the illustrative embodiment, the case 20 is formed to include a plurality of openings 36 that open to the gas path 25 as shown in FIGS. 3, 4, and 8A-14. The openings 36 are spaced apart circumferentially about the central axis 11 to define partitions 38 in the case 20. Each drum 26 is arranged in the case 20 so that the drum 26 is aligned with one of the openings 36 and each partition 38 is arranged between adjacent drums 26 as shown in FIGS. 8A-14. In the illustrative embodiment, each of the drums 26 extends partway into the corresponding opening 36. In this way, the outer surface 46 of each drum 26 cooperates with the inner surface 21 of the case 20 to define the outer boundary of the gas path 25.

It will be understood that the spacing of the drums 26 in FIGS. 1-14 are not to scale. For example, the drums 26 may be circumferentially spaced closer together or may be circumferentially spaced further apart in some embodiments.

In some embodiments, that there are no partitions 38. The drums 26 may be arranged closer together to minimize gaps there between and prevent fluid communication between the gas path 25 and the spaces between adjacent drums 26 and between the drums 26 and the case 20. In some embodiments, the assembly may include seals between adjacent drums 26 to limit leakage therebetween. In some embodiments, the partitions 38 may be formed between some, but not every drum 26. In the illustrative embodiment, the partitions 38 may be at least partially contoured to the shape of the drums 26 to seal or block a flow of fluid around the drums 26.

If the case 20 is a split case, like as shown in FIG. 4, the partitions 38 may be included in the forward section 32 of the case 20. In some embodiments, the partitions 38 may be part of the aft section 34 of the case 20. In some embodiments, the partitions 38 may be included in both the forward and aft sections 32, 34 of the case 20.

The inlet distortion mitigation system 22 includes the plurality of drums 26 and the control unit 30 as shown in FIGS. 2-14. Each of the drums 26 includes a drum body 40 and a pair of pegs 42, 44 as shown in FIG. 4. The drum body 40 extends between a first axial end 40A and a second axial end 40B spaced apart axially from the first axial end 40A. The drum body 40 defines an outer surface 46 that extends between the first and second axial ends 40A, 40B. The pair of pegs 42, 44 each extend from one of the axial ends 40A, 40B of the drum body 40 to the case 20 to couple the respective drum 26 to the case 20. The pair of pegs 42, 44 extend axially from the first and second axial ends 40A, 40B of the drum body 40 to fit into peg holes 42H, 44H formed in the forward and aft sections 32, 34 of the case 20.

The drum body 40 is formed to define a first or leading edge groove 28A and a second or trailing edge groove 28B as shown in FIGS. 2-14. The grooves 28A, 28B extend radially partially into the drum body 40 relative to the drum axis A. The grooves 28A, 28B each extend axially partway along a portion of the drum body 40 relative to the drum axis A, between the first and second axial ends 40A, 40B of the drum body 40.

The drums 26 are rotatable between the closed position, a leading edge open position, and a trailing edge open position to open/close off the grooves 28A, 28B from the gas path 25 to control the tip treatment for the fan blades 14. The drums 26 are rotated about the respective drum axis A to change the angle or position of grooves 28A, 28B of the drums 26 relative to the gas path 25, thereby exposing at least one or both of the grooves 28A, 28B to the gas path 25 to direct flow into the grooves 28A, 28B. The grooves 28A, 28B create recesses in the outer boundary of the gas path 25 to allow air to recirculate at the tips of the fan blades 14.

In the closed position, both the leading edge groove 28A and the trailing edge groove 28B of each drum 26 faces away from the gas path 25 so that the outer surface 46 of the corresponding drum 26 cooperates with the inner surface 21 to define a portion of the outer boundary of the gas path 25, thereby removing the tip treatment benefit. In the closed position, both the leading edge groove 28A and the trailing edge groove 28B of each drum 26 are arranged to be closed off from the gas path 25 such that the groove 28 is facing away from the gas path 25 in the illustrative embodiment.

In the closed position, the leading edge groove 28A is at a first leading edge closed angle, extending circumferentially or parallel to the gas path 25 as shown in FIG. 8A and the trailing edge groove 28B is at a first trailing edge closed angle 26B as shown in FIG. 8B. In the illustrative embodiment, the first leading edge closed angle positions the leading edge groove parallel to the gas path 25 and the first trailing edge closed angle 26B is about 45 degrees. In the leading edge open position, the leading edge groove 28A is at a leading edge open angle 26A as shown in FIG. 9A and the trailing edge groove 28B is at a second trailing edge closed angle 26B as shown in FIG. 9B. In the illustrative embodiment, the leading edge open angle 26A is about 90 degrees and the second trailing edge closed angle 26B is about 45 degrees. In the trailing edge open position, the leading edge groove 28A is at a second leading edge closed angle 26A as shown in FIG. 10A and the trailing edge groove 28B is at a trailing edge open angle 26B as shown in FIG. 10B. In the illustrative embodiment, the trailing edge open angle 26B is about 90 degrees and the second leading edge closed angle 26A is about 45 degrees.

In some embodiments, the leading edge groove 28A may be arranged to extend circumferentially when the corresponding drum 26 is in the closed position or the trailing edge open position so that the leading edge groove 28A remains facing away from the gas path 25. In some embodiments, the leading edge groove 28A may be arranged to extend radially and circumferentially or may be angled when the corresponding drum 26 is in the closed position or the trailing edge open position so that the leading edge groove 28A remains facing away from the gas path 25. In other words, in the closed position or the trailing edge open position, the leading edge groove 28A of the corresponding drum 26 faces away from the gas path 25 such that the leading edge groove 28A is not open to the gas path 25.

In some embodiments, the trailing edge groove 28B may be arranged to extend circumferentially when the corresponding drum 26 is in the closed position or the leading edge open position so that the trailing edge groove 28B remains facing away from the gas path 25. In some embodiments, the trailing edge groove 28B may be arranged to extend radially and circumferentially or may be angled when the corresponding drum 26 is in the closed position or the leading edge open position so that the trailing groove 28B remains facing away from the gas path 25. In other words, in the closed position or the leading edge open position, the trailing edge groove 28B of the corresponding drum 26 faces away from the gas path 25 such that the trailing edge groove 28B is not open to the gas path 25.

In the leading edge open position, the leading edge groove 28A of each drum 26 faces radially inward toward the gas path 25 to form the recess and allows the flow of air into the leading edge groove 28A. In the leading edge open position, the leading edge groove 28A of each drum 26 is arranged to extend radially relative to the central axis, perpendicular to the inner surface 21 and facing towards the gas path 25—in other words, rotated from the closed position so the leading edge groove 28A faces the inner surface 21 of the case 20 and forms part of the boundary of the gas path 25.

In the trailing edge open position, the trailing edge groove 28B of each drum 26 faces radially inward toward the gas path 25 to form the recess and allows the flow of air into the trailing edge groove 28B. In the trailing edge open position, the trailing edge groove 28B of each drum 26 is arranged to extend radially relative to the central axis, perpendicular to the inner surface 21 and facing towards the gas path 25—in other words, rotated from the closed position so the trailing edge groove 28B faces the inner surface 21 of the case 20 and forms part of the boundary of the gas path 25.

In the illustrative embodiment, the plurality of drums 26 may rotate in either direction about the drum axis A between the different positions. In some embodiments, the plurality of drums 26 may be configured to rotate in a first direction about the drum axis A from the closed position to the leading edge open position or the trailing edge open position. The drums 26 may be configured to rotate in a second direction about the respective drum axis A opposite the first direction to go back to the closed position. In some embodiments, the drums 26 may be configured to continue to rotate in the first direction to go back to the closed position.

The plurality of drums 26 may be configured to rotate in the second direction about the drum axis A from the closed position to the leading edge open position or the trailing edge open position. The drums 26 may be configured to rotate in the first direction about the respective drum axis A opposite the second direction to go back to the closed position. In some embodiments, the drums 26 may be configured to continue to rotate in the second direction to go back to the closed position.

In some embodiments, each of the drums 26 may be configured to rotate 180 degrees about the drum axis A. The plurality of drums 26 may configured to rotate in the first direction 180 degrees about the drum axis A from the closed position to another closed position with the drum 26 flipped. The plurality of drums 26 may configured to rotate in the second direction 180 degrees about the drum axis A from the closed position back to the original closed position with the drum 26. In some embodiments, each of the drums 26 may be configured to rotate 360 degrees about the drum axis A in either the first direction and/or the second direction.

In some embodiments, the leading edge grooves 28A and trailing edge grooves 28B may be configured so that their respective orientations correspond with missions and/or maneuvers. For example, the drums 26 and/or grooves 28 may be configured such that when a drum 26 is rotated in a first direction, the drum steps through what tip treatment may be needed first in a sequence of treatments, and then, while still rotating in the first direction, what tip treatment is needed second.

For example, in a maneuver where a trailing edge tip treatment (the drum 26 rotated to the trailing edge open position, as shown in FIGS. 10A and 10B) is needed first and a leading edge tip treatment (the drum 26 rotated to the leading edge open position, as shown in FIGS. 9A and 9B) is needed second, the drums 26 and/or grooves 28 may be arranged such that rotation of the drum in a first direction rotates sequentially first to the trailing edge open position and then second to the leading edge open position. The drums 26 and/or grooves 28 may be configured to suit a specific application/mission design, and in this way, may operate like cams that turn during a cycle and may be designed for a particular application. In this way, for example, a ratchet and pawl system may be used rather than a system that rotates the drums 26 in both directions.

The control unit 30 includes at least one actuator 60, a controller 62, a memory 64, and at least one sensor 66 as shown in FIGS. 3 and 8A-14. The actuator 60 is coupled to drums 26. The actuator 60 is configured to drive the rotating motion of the drums 26. The controller 62 is coupled to the actuator 60 to direct the actuator 60 to rotate the drums 26 between the different positions.

The actuator 60 is configured to rotate the drums 26 between the closed position as shown in FIGS. 8A-8B, the leading edge open position as shown in FIGS. 9A-9B, and the trailing edge open position as shown in FIGS. 10A and 10B. The actuator 60 may also be configured to rotate the drums 26 to intermediate positions between the closed, the leading edge open position, and the trailing edge open position. The controller 62 is configured to direct the actuator 60 to rotate the drums 26 between the different positions in response to preselected operating conditions. The preselected operating conditions include the plurality of preprogrammed aircraft maneuvers stored on the memory 64 included in the control unit 30.

The controller 62 of the control unit 30 is configured to detect a preprogrammed aircraft maneuver included in the plurality of preprogrammed aircraft maneuvers on the memory 64. Once the preprogrammed aircraft maneuver is detected, the controller 62 directs the actuator 60 to rotate some or all of the drums 26 to a corresponding position in response to detecting the preprogrammed aircraft maneuver.

An extension linkage or rod may be coupled to one of the pegs 42, 44 at and end of each drum 26 that may be directly or indirectly coupled to the actuator 60. A crank may be positioned outside of the fan case 20, and may link the actuator 60 to the drums 26. The drums 26 may be ganged together, for example, with gears, a curved rack, and/or a belt. Additionally or alternatively, a motor may be disposed at the end of each drum 26 for individual control of the drums 26, and may be included in the fan case 20.

In some embodiments, multiple drums 26 may be coupled together to sync movement of the drums 26. The drums 26 may be coupled or linked together so that when the controller 62 directs the actuator 60 to rotate the drums 26, the actuator 60 moves to simultaneously rotate the plurality of coupled drums 26 to the desired position.

In some embodiments, different sets of drums 26 may be coupled together. The control unit 30 may include multiple actuators 60 each coupled to a respective different set of coupled drums 26 to control the positions of the drums 26 in groups so that some of the drums 26 move together in unison, while other drums 26 are independently controlled from the first group.

In some embodiments, the control unit 30 includes a separate actuator 60 for each drum 26. Each actuator 60 may be coupled to one of the respective drums 26. In this way, the controller 62 independently controls the position of each drum 26.

In some embodiments, the actuator 60 may include pneumatic or electric actuators, or combinations of hydraulic, pneumatic, and electric. Any other actuator known to a person skilled in the art could be utilized as well.

The controller 62 of the control unit 30 is configured to direct the actuator(s) 60 to rotate some or all of the drums 26 from the closed position to the to the leading edge open position or the trailing edge open position based on the detected preprogrammed aircraft maneuver. As shown in FIGS. 8A and 8B, the controller 62 has directed the actuator(s) 60 to rotate all of the drums 26 to the closed position. As shown in FIGS. 9A and 9B, the controller 62 has directed the actuator(s) 60 to rotate all of the drums 26 to the leading edge open position. As shown in FIGS. 10A and 10B, the controller 62 has directed the actuator(s) 60 to rotate all of the drums 26 to the trailing edge open position.

Figure 11A:
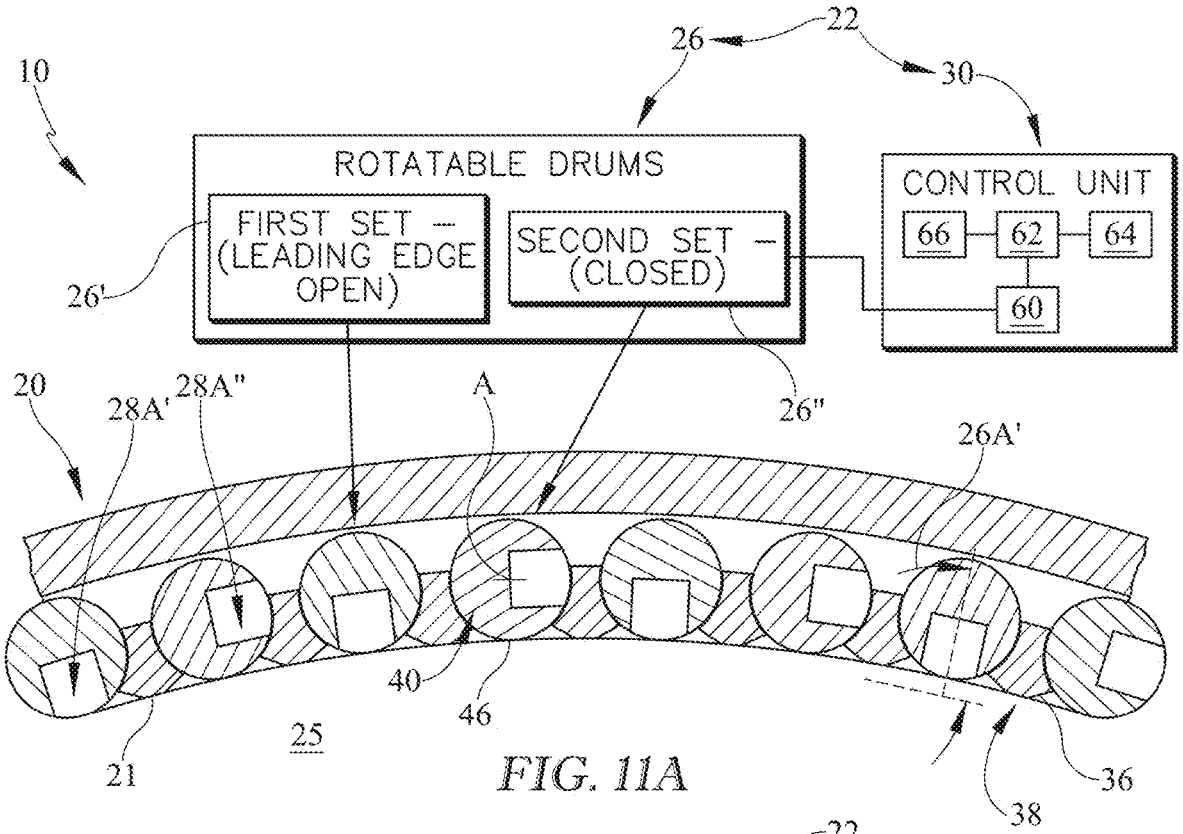
FIG. 11A is an axial cross-section view at the leading edge grooves of fan case assembly of FIG. 3 showing the plurality of drums may be rotated in different sets, the sets of drums includes a first set of drums and a second set of drums alternated circumferentially between the first set of drums, and further showing the first set of drums are in the leading edge open position like as shown in FIG. 9A so that the leading edge groove of the corresponding drum faces towards and is open to the gas path to allow air to flow into the leading edge groove from the gas path to provide the tip treatment to the fan blades, the second set of drums located in the closed position like as shown in FIG. 8A, in which the leading edge groove of the corresponding drum faces away from the gas path to close off the leading edge groove from the gas path.
Figure 11B:
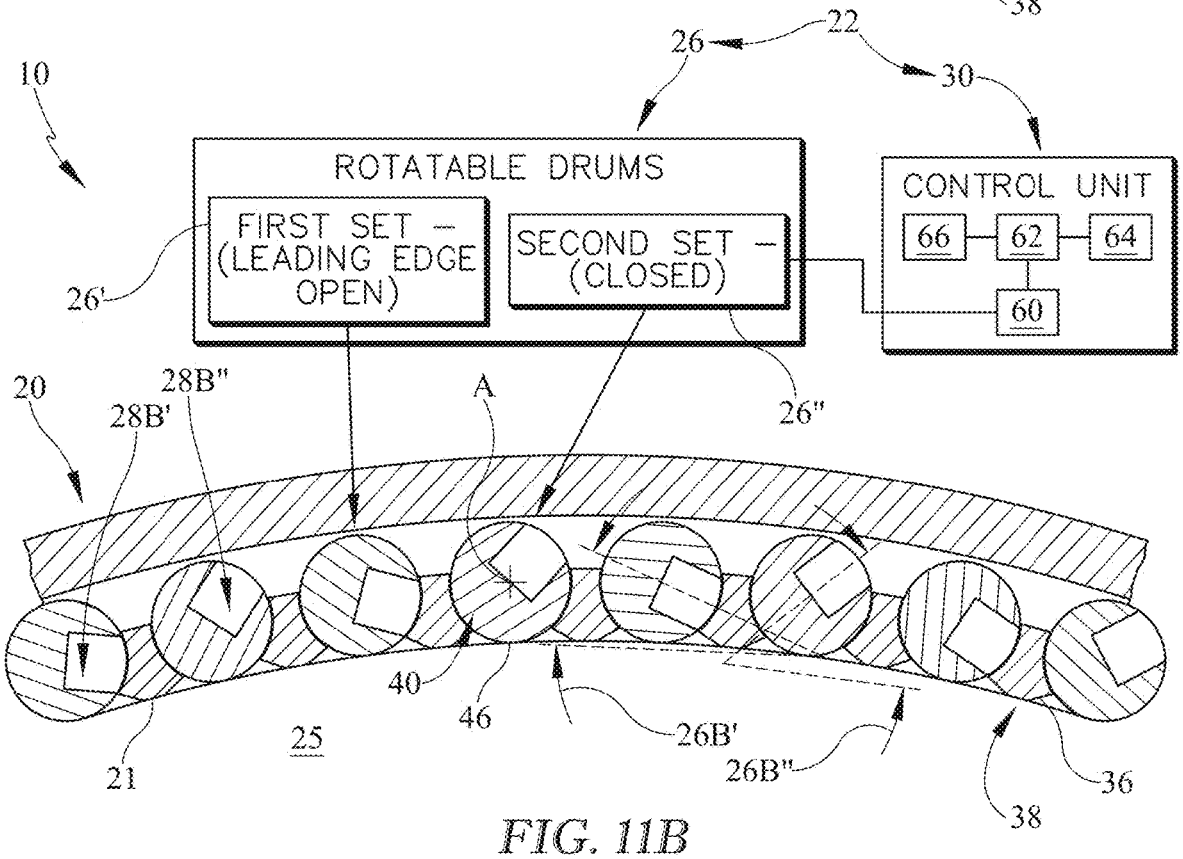
FIG. 11B is an axial cross-section view at the trailing edge grooves of fan case assembly of FIG. 3 showing the plurality of drums may be rotated in different sets, the sets of drums includes a first set of drums and a second set of drums alternated circumferentially between the first set of drums, and further showing the first set of drums are in the leading edge open position like as shown in FIG. 9B in which the trailing edge groove of the corresponding drum faces away from the gas path to close off the trailing edge groove from the gas path, the second set of drums located in the closed position like as shown in FIG. 8B, in which the trailing edge groove of the corresponding drum also faces away from the gas path to close off the trailing edge groove from the gas path.
Figure 12A:
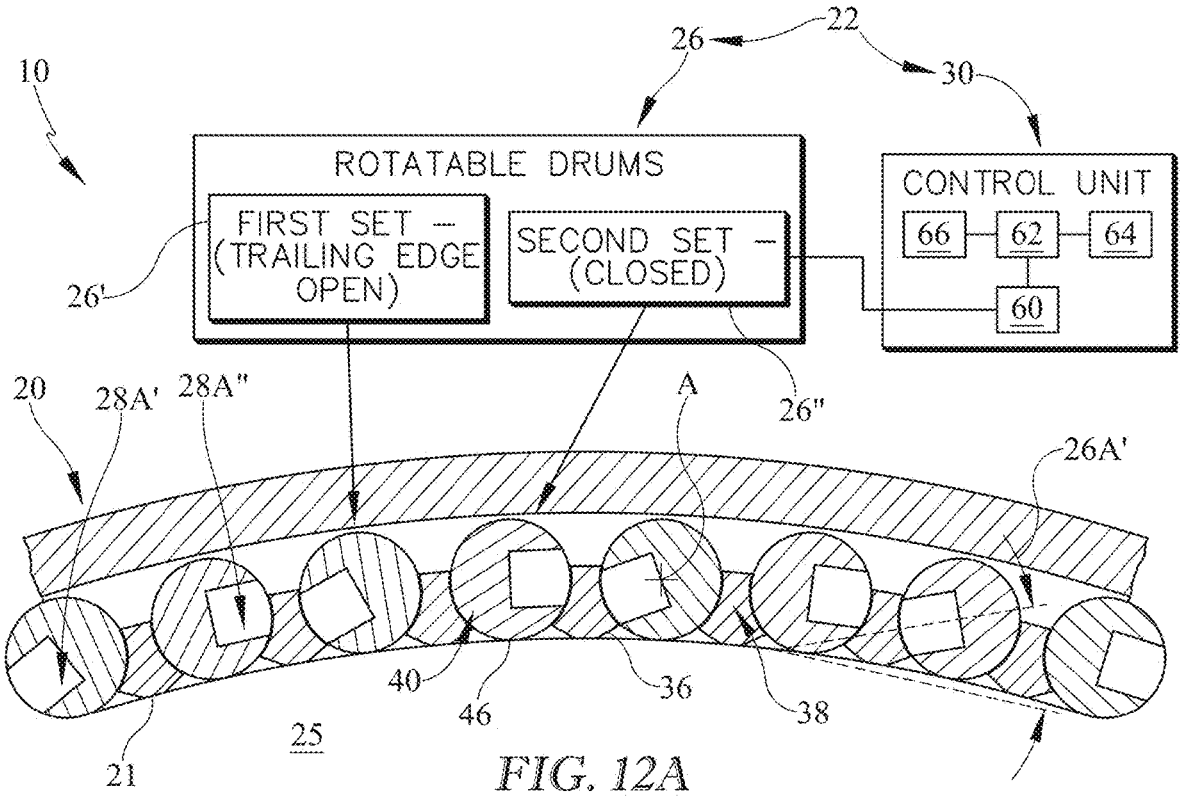
FIG. 12A is an axial cross-section view at the leading edge grooves of fan case assembly of FIG. 3 showing the plurality of drums may be rotated in different sets, the sets of drums includes a first set of drums and a second set of drums alternated circumferentially between the first set of drums, and further showing the first set of drums are in the trailing edge open position like as shown in FIG. 10A in which the leading edge groove of the corresponding drum faces away from the gas path to close off the leading edge groove from the gas path, the second set of drums located in the closed position like as shown in FIG. 8A, in which the leading edge groove of the corresponding drum also faces away from the gas path to close off the leading edge groove from the gas path.
Figure 12B:
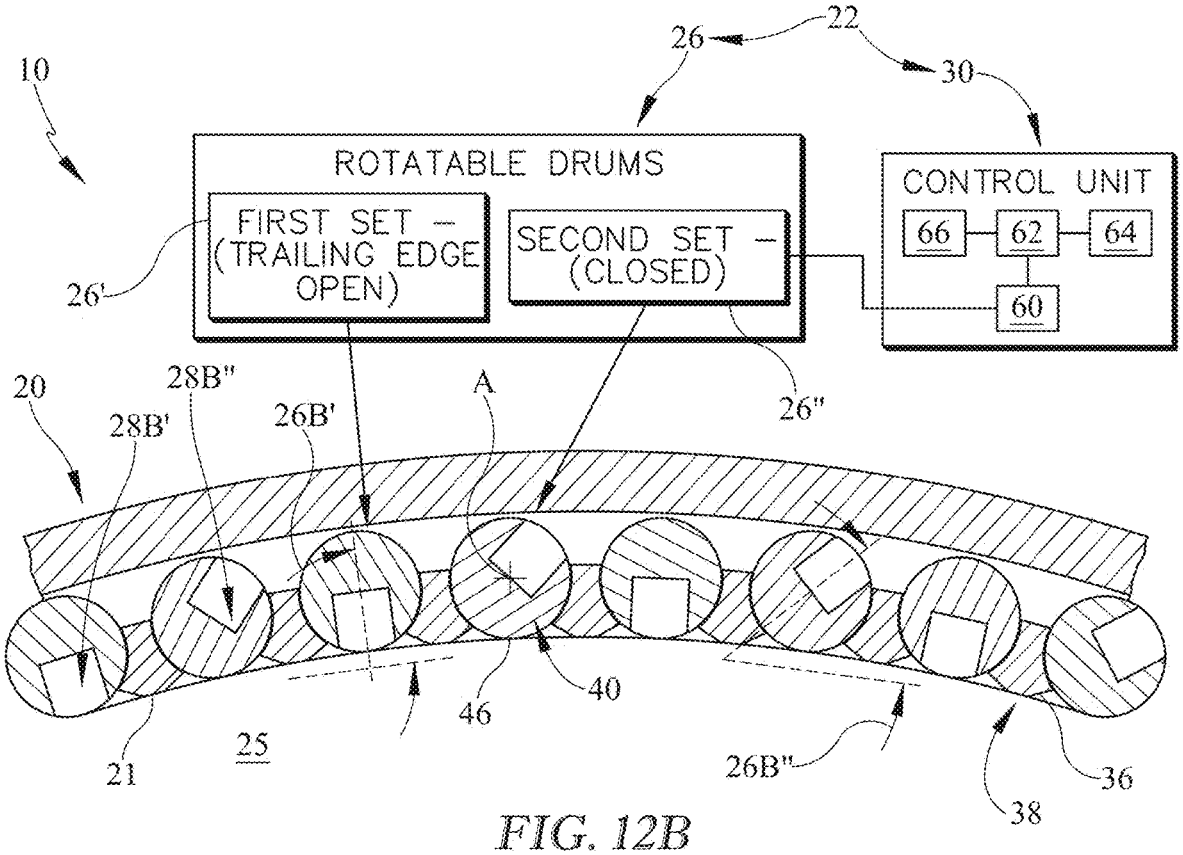
FIG. 12B is an axial cross-section view at the trailing edge grooves of fan case assembly of FIG. 3 showing the plurality of drums may be rotated in different sets, the sets of drums includes a first set of drums and a second set of drums alternated circumferentially between the first set of drums, and further showing the first set of drums are in the trailing edge open position like as shown in FIG. 10B so that the trailing edge groove of the corresponding drum faces towards and is open to the gas path to allow air to flow into the leading edge groove from the gas path to provide the tip treatment to the fan blades, the second set of drums located in the closed position like as shown in FIG. 8B, in which the trailing edge groove of the corresponding drum faces away from the gas path to close off the trailing edge groove from the gas path.

Depending on the preprogrammed aircraft maneuver, the controller 62 of the control unit 30 may direct certain actuators 60 to only rotate certain drums 26 to one of the leading edge open position or the trailing edge open position, while keeping others in the closed position. As shown in FIGS. 11A and 11B, the controller 62 has directed the actuator(s) 60 to rotate some of the drums 26, or the first set of drums 26', to the leading edge open position, while keeping other drums 26, or a second set of drums 26", in the closed position. As shown in FIGS. 12A and 12B, the controller 62 has directed the actuator(s) 60 to rotate some of the drums 26, or the first set of drums 26', to the trailing edge open position, while keeping other drums 26, or a second set of drums 26", in the closed position.

In the leading edge open position, the leading edge groove 28A' of the first set of drums 26' is at the leading edge open angle 26A' as shown in FIG. 11A and the trailing edge groove 28B' of the first set of drums 26' is at the second trailing edge closed angle 26B' as shown in FIG. 11B. In the closed position, the leading edge groove 28A" of the second set of drums 26" is at the first leading edge closed angle 26A" as shown in FIG. 11A and the trailing edge groove 28B" of the second set of drums 26" is at the first trailing edge closed angle 26B" as shown in FIG. 11B. The leading edge open angle 26A', the first leading edge closed angle 26A", the first trailing edge closed angle 26B", and the second trailing edge closed angle 26B' may be the same or substantially similar to the leading edge open angle 26A, the first leading edge closed angle 26A, the first trailing edge closed angle 26B, and the second trailing edge closed angle 26B, respectively, as discussed above with respect to FIGS. 8A-10B. In the illustrative embodiment, the leading edge open angle 26A' is about 90 degrees and the closed angles 26A", 26B', and 26B" are each about 45 degrees.

FIGS. 11A and 11B show the first set of drums 26' at the same, leading edge open position and the second set of drums 26" at the same, closed position. FIG. 11A shows a cross-section view at the leading edge groove 28A of the first set of drums 26' in the leading edge open position and at the leading edge groove 28A of the second set of drums 26" in the closed open position. FIG. 11B shows a cross-section view at the trailing edge groove 28B of the first set of drums 26' in the leading edge open position and at the trailing edge groove 28B of the second set of drums 26" in the closed position. In other words, FIG. 11A and FIG. 11B show the same sets of drums 26', 26" in the same respective positions, but FIG. 11A shows an axial cross section at a first location along an axis A of the drums 26', 26", and FIG. 11B shows an axial cross section at a second location along the axis A of the drums 26', 26", axially aft of the first location shown in FIG. 11A.

As shown in FIGS. 12A and 12B, the controller 62 has directed the actuator(s) 60 to rotate some of the drums 26, or the first set of drums 26', to the trailing edge open position, while keeping other drums 26, or a second set of drums 26", in the closed position. In the trailing edge open position, the leading edge groove 28A' of the first set of drums 26' is at the second leading edge closed angle 26A' as shown in FIG. 12A and the trailing edge groove 28B' of the first set of drums 26' is at the trailing edge open angle 26B' as shown in FIG. 12B. In the closed position, the leading edge groove 28A" of the second set of drums 26" is at the first leading edge closed angle 26A" as shown in FIG. 12A and the trailing edge groove 28B" of the second set of drums 26" is at the first trailing edge closed angle 26B" as shown in FIG. 12B. The trailing edge open angle 26B', the first trailing edge closed angle 26B", the first leading edge closed angle 26A", and the second leading edge closed angle 26A' may be the same or substantially similar to the trailing edge open angle 26B, the first trailing edge closed angle 26B, the first leading edge closed angle 26A, and the second leading edge closed angle 26A, respectively, as discussed above with respect to FIGS. 8A-10B. In the illustrative embodiment, the trailing edge open angle 26B' is about 90 degrees and the closed angles 26A', 26A", and 26B" are each about 45 degrees.

FIGS. 12A and 12B show the first set of drums 26' at the same, trailing edge open position and the second set of drums 26" at the same, closed position. FIG. 12A shows a cross-section view at the leading edge groove 28A of the first set of drums 26' in the trailing edge open position and at the leading edge groove 28A of the second set of drums 26" in the closed open position. FIG. 12B shows a cross-section view at the trailing edge groove 28B of the first set of drums 26' in the trailing edge open position and at the trailing edge groove 28B of the second set of drums 26" in the closed position. In other words, FIG. 12A and FIG. 12B show the same sets of drums 26', 26" in the same respective positions, but FIG. 12A shows an axial cross section at a first location along an axis A of the drums 26', 26", and FIG. 12B shows an axial cross section at a second location along the axis A of the drums 26', 26", axially aft of the first location shown in FIG. 12A.

In the illustrative embodiment, the first set of drums 26' is alternated between the second set of drums 26" as shown in FIGS. 11A-12B. In some embodiments, the different sets 26', 26'" are arranged in series. In some embodiments, the different sets 26', 26" are arranged in groups spaced apart circumferentially. In some embodiments, the different sets 26', 26" may have drums 26 located at different circumferential locations spaced about the axis 11.

In the illustrative embodiment, the number of drums 26 in the first set of drums 26' is equal to the number of drums 26 in the second set of drums 26". In some embodiments, the number of drums 26 in one set 26', 26" may be less than or greater than the number of drums 26 in the other set 26', 26". In some embodiments, the controller 62 may not control the drums 26 in sets, but rather direct certain actuator(s) 60 to rotate certain drum(s) 26 to the leading edge or trailing edge open position, while keeping other drums 26 in the closed position.

In some embodiments, the control unit 30 may control the plurality of rotatable drums 26 in more than two sets. In some embodiments, the plurality of drums 26 may have more than two sets of drums. In some embodiments, may have less than two sets of drums.

The preselected operating conditions may further include a sensor input from the sensor 66 or sensors 66 included in the control unit 30. The sensor 66 is configured to measure one of pressure, air speed, and acceleration. The sensor 66 is also configured to detect distortion, fan stall, and/or other aeromechanical issues. In some embodiments, the control unit 30 includes a plurality of sensors 66 each configured to measure one of pressure, air speed, and acceleration and/or detect distortion, fan stall, and/or other aeromechanical issues.

The sensor 66 may include one of or a combination of dynamic sensors, static wall pressure sensors, altitude sensors, sensors configured to detect the angle of attack of the plurality of fan blades 14, sensors configured to detect the tip timing of the plurality of fan blades 14, and air speed sensors. In some embodiments, the sensor 66 may be a dynamic pressure transducer. The sensor 66 may also be a sensor configured to measure a rotational speed of the fan blades 14, which could be used along with an additional sensor that is a dynamic pressure transducer. In some embodiments, the sensor 66 may be a sensor configured to measure a rotation speed of another section of the engine 110.

The controller 62 of the control unit 30 is configured to receive a measurement from the sensor 66 or sensors 66 and direct the actuator 60 to rotate some or all of the drums 26 to a corresponding position in response to the measurement of the at least one sensor 66. The controller 62 of the control unit 30 may be configured to direct actuator 60 to rotate some or all of the drums 26 to the closed position when the measurements from the sensor 66 are within a predetermined threshold.

Then, when the measurement from the sensor 66 is outside of the predetermined threshold, the controller 62 directs the actuator 60 to rotate some or all of the drums 26 to the leading edge open position or the trailing edge open position. Based on the difference of the measurement from the sensor 66 compared to the predetermined threshold, the controller 62 may vary the position of the drums 26 to control the tip treatment applied to the fan blades 14 by opening/closing the grooves 28A, 28B to the gas path 25.

In some embodiments, the controller 62 of the control unit 30 may be configured to use a combination of the sensor measurements and the detected preprogrammed aircraft maneuver to control the position of the drums 26. For example, when the controller 62 of the control unit 30 detects a preprogrammed aircraft maneuver and the measurement is outside of the predetermined threshold, the controller 62 directs the actuator 60 to rotate some or all of the drums 26 to the leading edge open position or the trailing edge open position.

In some embodiments, the controller 62 of the control unit 30 is configured to use the measurements from the sensor 66 to anticipate the aircraft maneuver. The controller 62 of the control unit 30 is configured to direct the actuator 60 to rotate some or all of the drums 26 to the leading edge open position or the trailing edge open position in response to the measurement from the sensor 66 even though no preprogrammed aircraft maneuver is detected.

Alternatively, there may be a delay in the measurements from the sensor 66. Therefore, the controller 62 of the control unit 30 is also configured to direct the actuator 60 to rotate some or all of the drums 26 to the leading edge open position or the trailing edge open position when the one of the preprogrammed aircraft maneuvers is detected, even though the measurements from the sensor 66 are within the predetermined thresholds.

In some embodiments, the controller 62 of the control unit 30 may detect one of the preprogrammed aircraft maneuvers, but the measurements from the sensors 66 are within the predetermined threshold. If so, the controller 62 of the control unit 30 may direct some or all of the drums 26 to remain in the current position.

A method of operating the inlet distortion mitigation system 22 may include several steps. During normal cruise conditions, the controller 62 directs the actuator 60 to locate the rotatable drums 26 in the closed position. In other words, the inlet distortion mitigation system 22 is kept in the closed mode during normal cruise conditions so that the at least one or the grooves 28A, 28B face away from the gas path 25.

If the controller 62 detects one of a preselected operating condition other than the cruise condition, the controller 62 directs the actuator 60 to rotate the drums 26 to the leading edge open position or the trailing edge open position depending on the operating condition detected to minimize the negative effects of pressure and swirl distortions to improve stall margin. In other words, the inlet distortion mitigation system 22 changes to the leading edge open mode or the trailing edge open mode so that at least one of the grooves 28A, 28B face toward the gas path 25. In the leading edge open position or trailing edge open position, at least one of the grooves 28A, 28B of the drums 26 may extend radially relative to the axis 11.

The method further includes continually adjusting the position of some or all of the drums 26 based on the preselected operating condition of the engine 110. If the controller 62 detects the cruise condition the controller 62 directs the actuator 60 to rotate the drums 26 back to the closed position. In other instances, the controller 62 may direct the actuator 60 to control the position of the drums 26 as discussed above based on the preprogrammed aircraft maneuvers and/or the measurements from the sensors.

The grooves 28A, 28B of the corresponding drums 26 face away from the gas path 25 whenever the groove 28A, 28B is closed off from or not open to the gas path 25 so that fluid communication between the gas path 25 and the groove 28A, 28B is blocked. As shown at least in FIGS. 8A, 8B, 9B, and 10A, the grooves 28A, 28B face away from the gas path 25. In some embodiments, the grooves 28A, 28B may extend radially and circumferentially relative to the axis 11, but still remain aways toward the gas path 25 as the grooves 28 are still blocked and not in fluid communication with the gas path 25.

The grooves 28A, 28B of the corresponding drums 26 face towards the gas path 25 whenever the groove 28A, 28B is open to the gas path 25 so that fluid communication between the gas path 25 and the groove 28A, 28B is allowed. As shown in FIGS. 9A and 10B the grooves 28A, 28B face radially inward toward the gas path 25.

When dealing with embedded inlet distortion, there may be a steep trade between stall margin and performance of the engine. Attempting to solve the worst stall condition, while maintaining performance over all of the cycle or flight conditions may be difficult and result in compromised efficiency or a limited flight envelope.

As indicated above, the grooves 28A, 28B extend a certain depth $D_B$, $D_A$ into to the drum 26. In illustrative embodiments a depth of the leading edge grooves 28A and the trailing edge grooves 28B in each of the corresponding drums 26 may be substantially similar or equal. In illustrative embodiments a depth either the leading edge grooves 28A or the trailing edge grooves 28B may vary or differ between from drum 26 to drum. In illustrative embodiments, as shown in FIGS. 13-14, different drums 26', 26" included in the plurality of rotatable drums 26 have grooves 28', 28", which represent either the leading edge grooves 28A and/or the trailing edge grooves 28B, of varying depths.

Figure 13:
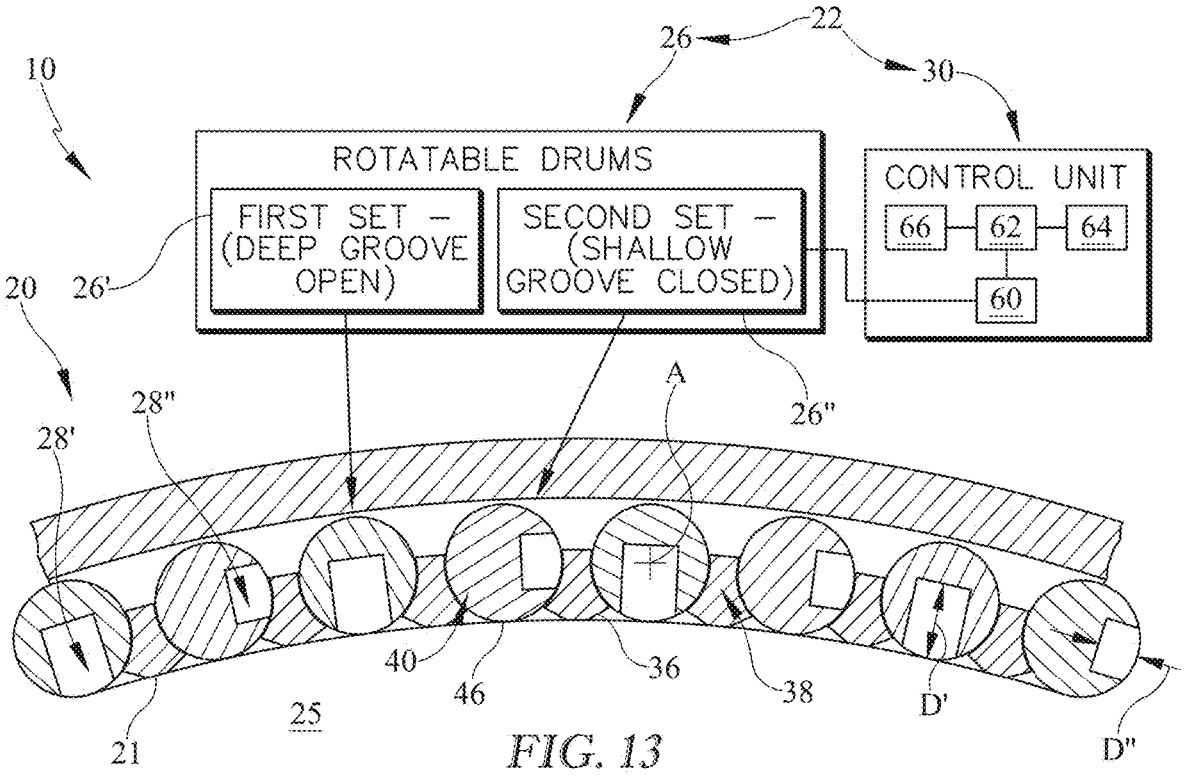
FIG. 13 is a circumferential cross-section view of another embodiment of a fan case assembly included in the gas turbine engine of FIG. 1 showing the plurality of drums may be rotated in different sets, the sets of drums includes a first set of drums and a second set of drums alternated circumferentially between the first set of drums, and further showing the first set of drums having a deep groove with a first depth the open position in which the deep groove faces towards the gas path, and the second set of drums having a shallow groove with a second depth that is less than the first depth of the deep groove, the second set of drums in the closed position facing away from the gas path.

As shown in FIG. 13, the plurality of drums 26 may include a first set of drums 26' with a relatively deep groove 28' and a second set of drums 26" with a relatively shallow groove 28" compared to the groove 28' on the first set of drums 26'. The deep groove 28'—also referred to as the first groove 28'—has a first depth D', while the shallow groove 28"—also referred to as the second groove 28"—has a second depth D" as shown in FIG. 13. In FIG. 13, the second depth D" of the shallow groove 28" is less than the first depth D' of the deep groove 28'. In FIG. 13, the depth D' of the first groove 28' of the first set of drums 26' is greater than the depth D" of the second groove 28" of the second set of drums 26" such that the first groove 28' extends further in to the respective drum of the first set of drums 26' than the second groove 28" extends into the respective drum of the second set of drums 26".

Figure 14:
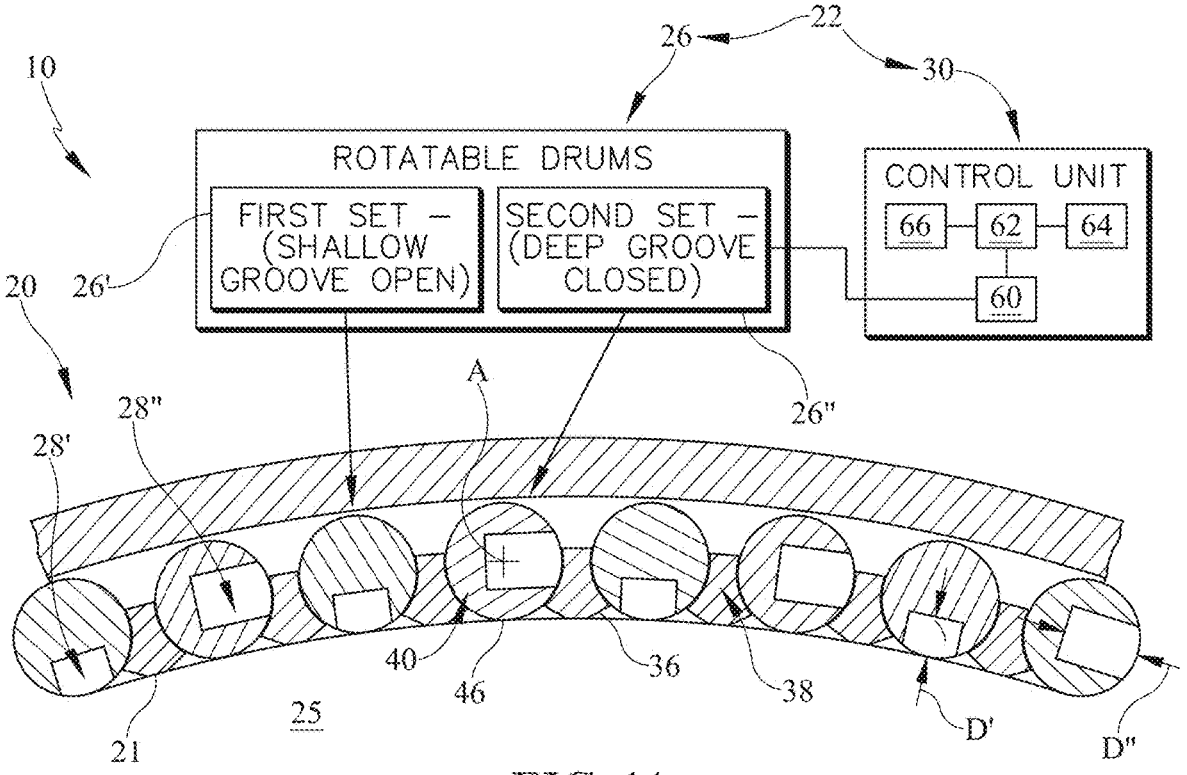
FIG. 14 is a circumferential cross-section view of another embodiment of a fan case assembly included in the gas turbine engine of FIG. 1 showing the plurality of drums may be rotated in different sets, the sets of drums includes a first set of drums and a second set of drums alternated circumferentially between the first set of drums, and further showing the first set of drums having a shallow groove with a first depth the open position in which the shallow groove faces towards the gas path, and the second set of drums having a deep groove with a second depth that is greater than the first depth of the shallow groove, the second set of drums in the closed position facing away from the gas path.

Alternatively, as shown in FIG. 14, the plurality of drums 26 may include a first set of drums 26' with a relatively shallow groove 28' and a second set of drums 26" with a relatively deep groove 28" compared to the groove 28' on the first set of drums 26'. The shallow groove 28' ≠also referred to as the first groove 28'—has a first depth D', while the deep groove 28"—also referred to as the second groove 28"—has a second depth D" as shown in FIG. 14. In FIG. 14, the first depth D' of the shallow groove 28' is less than the second depth D" of the deep groove 28". In FIG. 14, the depth D' of the first groove 28' of the first set of drums 26' is less than the depth D" of the second groove 28" of the second set of drums 26" such that the second groove 28" extends further in to the respective drum of the first set of drums 26' than the first groove 28' extends into the respective drum of the second set of drums 26". As shown in FIG. 14, the plurality of drums 26 may include a first set of drums 26' with a relatively shallow groove 428' and a second set of drums 26" with a relatively deep groove 28" compared to the groove 28' on the first set of drums 26'.

The drums 26 are rotatable between the closed position and an open position (either the trailing edge open position or the leading edge open position depending on if the groove 28', 28" is the leading edge groove 28A or the trailing edge groove 28B) to close/open each groove 28', 28" formed in the drums 26', 26" to the gas path 25, thereby controlling the tip treatment applied to the fan blades 14. The control unit 30 is configured to rotate the drums 26 between the different positions in response to preselected operating conditions. The control unit 30 is configured to control the position of the drums 26 similar to the control unit 30 in FIGS. 1-12B.

Depending on the preprogrammed aircraft maneuver, the controller 62 of the control unit 30 may direct certain actuators 60 to only rotate certain drums 26 to one of the leading edge open position or the trailing edge open position, while keeping others in the closed position. As shown in FIGS. 13, the controller 62 has directed the actuator(s) 60 to rotate some of the drums 26, or the first set of drums 26' with the deep groove 28', to the open position, while keeping other drums 26, or a second set of drums 26" with the shallow groove 28", in the closed position. As shown in FIG. 14, the controller 62 has directed the actuator(s) 60 to rotate some of the drums 26, or the second set of drums 26" with the deep groove 28", to the closed position, while keeping other drums 26, or the first set of drums 26' with the shallow groove 28', in the open position.

In the illustrative embodiment, the first set of drums 26' is alternated between the second set of drums 26" as shown in FIGS. 13-14. In some embodiments, the different sets 26', 26" are arranged in series. In some embodiments, the different sets 26', 26" are arranged in groups spaced apart circumferentially. In some embodiments, the different sets 26', 26" may have drums 26 located at different circumferential locations spaced about the axis 11.

In the illustrative embodiment, the number of drums 26 in the first set of drums 26' is equal to the number of drums 26 in the second set of drums 26". In some embodiments, the number of drums 26 in one set 26', 26" may be less than or greater than the number of drums 26 in the other set 26', 26". In some embodiments, the controller 62 may not control the drums 26 in sets, but rather direct certain actuator(s) 60 to rotate certain drum(s) 26 to the open position, while keeping other drums 26 in the closed position.

Depending on the preprogrammed aircraft maneuver, the controller 62 of the control unit 30 may direct certain actuators 60 to only rotate certain drums 26 to the open position, while keeping others in the closed position. As shown in FIG. 13, the controller 62 has directed the actuator(s) 60 to rotate some of the drums 26, or the first set of drums 26', to the open position, while keeping other drums 26, or a second set of drums 26", in the closed position. In this way, the deep grooves 28' are open to the gas path 25, while the shallow grooves 28" are blocked off or closed off from the gas path 25.

As shown in FIG. 14, the controller 462 may direct the actuator(s) 60 to rotate the first set of drums 26' to the open position, while keeping the second set of drums 26" in the closed position. As shown in FIG. 14, the deep grooves 428" are blocked off or closed off from the gas path 25, while the shallow grooves 428' are open to the gas path 25.

Depending on preselected operating condition detected, the control unit 30 may change the inlet distortion mitigation system 22 to a first open mode like as shown in FIG. 13 or a second open mode like as shown in FIG. 14. In the first open mode, the drums 26' are in the open position so that the deep grooves 28' are open to the gas path 25, while the shallow grooves 28" are closed off from the gas path 25. In the second open mode, the drums 26' are in the open position so that the shallow grooves 28' are open to the gas path 25, while the deep grooves 28" are closed off from the gas path 25. Compared to the second open mode, the deeper grooves 28' of the drums 26' provide more radial flow compared to the shallow grooves 28".

The fan 112 includes an inlet distortion mitigation system 22 which includes a plurality of rotatable drums 26 configured to control fluid communication between the grooves 28 and the gas path 25. The plurality of rotatable drums 26 may be rotated all together or in sets/groups to expose the tips of the fan blades 14 to the grooves 28.

The flow path or gas path 25 between the drums 26 is a static flow path or has partitions 38 so when the grooves 28 are rotated away from the gas path 25, the gas path 25 is relatively smooth. Then the drums 26 be rotated to expose the grooves 28 to the gas path 25 and direct flow into the grooves 28.

In the illustrative embodiment, the partitions 38 may block part of the groove 28 in certain positions to vary the size of the opening to the groove 28 thereby modulating the flow therethrough. For example, if the grooves 28 are angled so that the groove 28 extends radially and circumferentially, the partition 38 may partially block the groove 28. In some embodiments, the partitions 38 do not block the opening to the groove 28 such that in the open position the grooves 28 are completely open to the gas path 25.

The rotating drums 26 may be incorporated into the fan case 20 or into liners and operated via a variable geometry system similar to variable vanes. The actuator(s) 60 may be similar to the variable geometry system used with variable vanes.

In the first condition, or the closed position, the grooves 28 be closed so no additional stall margin is created, but performance is not compromised. In a second condition, or one of the open positions, the plurality of drums 26 rotates to permit flows into the grooves 28 to provide tip treatment benefits to the fan blades 14. The angle of the grooves 28 of the drums 26 may be adjusted to tune the arrangement to particular needs or conditions.

The plurality of drums 26 permit the fan 112 to optimize efficiency at a cruise point with limited distortion, while being able to maintain adequate stall margin at another condition. By activating the rotatable drums 26 to trade efficiency for stall margin improvement, but not have to live with that trade at all times, the inlet distortion mitigation system 22 allows optimization of the fan 112.

The drums 26 rotate to open or close the flow of air into the grooves 28. The grooves 28 of the respective drums 26 may be rotated to a range of angles between 0 to about 90 degrees. This may be done with all drums 26 controlled the same, or with different angles for different sectors via ganging.

The control unit 30 is configured to use sensor inputs from a sensor 66 to control operation of the drums 26. The sensor 66 may include one of or a combination of a static wall pressure sensor, an altitude sensor, sensors configured to detect twisting of the fan blades 14, sensors configured to detect the tip timing of the fan blades 14, sensors configured to measure a rotational speed of the fan blades 14, a dynamic pressure transducer sensor. The combination of some sensors may provide data to engage mitigation of the effects of distortion, while other sensors may detect the maneuvers or mission phase.

For example, altitude and fan speed may provide data to engage mitigation, while also providing maneuver detection or regime/mission phase framing of control logic. Additionally, static wall pressure, dynamic pressure transducers, blade tip timing, blade untwist as well as fan speed and altitude may be used in distortion/effect detection for the control logic.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A fan case assembly adapted for use with a gas turbine engine, the fan case assembly comprising a case that extends circumferentially at least partway about a central axis of the fan case assembly to define an outer boundary of a gas path of the gas turbine engine, the case formed to define a channel that extends circumferentially at least partway about the central axis, a plurality of drums arranged in the channel and spaced circumferentially about the central axis, each drum of the plurality of drums including a first groove and a second groove spaced axially along the drum form the first groove that each extend partway into the corresponding drum, each drum of the plurality of drums is configured to rotate about a respective drum axis between a closed position in which the first groove and the second groove of the corresponding drum both face away from the gas path so that the outer surface of the corresponding drum cooperates with an inner surface of the case to define the outer boundary of the gas path, a first open position in which the first groove of the corresponding drum faces radially inward towards the gas path while the second groove remains facing away from the gas path, and a second open position in which the second groove of the corresponding drum faces radially inward towards the gas path while the first groove remains facing away from the gas path, and a control unit configured to rotate the plurality of drums about the respective drum axis between the closed position, the first open position, and the second open position in response to preselected operating conditions to minimize negative effects pressure and swirl distortions in the gas turbine engine to improve stall margin.

2. The fan case assembly of claim 1, wherein the first groove is disposed closer to a first axial end of the drum that the second groove and the second groove is disposed closer to a second axial end of the drum than the first groove, the second axial end opposite from the first axial end.

3. The fan case assembly of claim 1, wherein the first groove is disposed closer to a leading edge of a fan blade that the second groove and the second groove is disposed closer to a trailing edge of the fan blade than the first groove.

4. The fan case assembly of claim 1, wherein the first groove extends through the corresponding drum at a first angle relative to the gas path and the second groove extend through the corresponding drum at a second angle relative to the gas path, the second angle different from the first angle.

5. The fan case assembly of claim 1, wherein the plurality of drums includes a first set of drums and a second set of drums and the control unit is configured to rotate the first set of drums between the closed position, the first open position, and the second open position independent of the second set of drums.

6. The fan case assembly of claim 5, wherein the first set of drums are alternated circumferentially between the second set of drums.

7. The fan case assembly of claim 5, wherein at least one of the first groove or the second groove on each respective drum of the first set of drums has a first depth and at least one of the first groove or the second groove on each respective drum of the second set of drums has a second depth, wherein the first depth is greater than the second depth.

8. The fan case assembly of claim 1, wherein each drum of the plurality of drums has a cylindrical shape that defines a first end, a second end spaced apart axially from the first end, and the outer surface that extends axially between the first end and the second end and circumferentially about the corresponding drum axis.

9. The fan case assembly of claim 1, wherein each drum of the plurality of drums has a cylindrical shape that defines a first end, a second end spaced apart axially from the first end, and an outer surface that extends axially between the first end and the second end and circumferentially about the corresponding drum axis, and wherein the outer surface of each drum of the plurality of drums at an axial position of the second groove cooperates with an inner surface of the gas path to define a portion of the outer boundary of the gas path when each drum of the plurality of drums is in the first open position to block fluid communication with the second groove.

10. The fan case assembly of claim 1, wherein each drum of the plurality of drums has a cylindrical shape that defines a first end, a second end spaced apart axially from the first end, and an outer surface that extends axially between the first end and the second end and circumferentially about the corresponding drum axis, and wherein the outer surface of each drum of the plurality of drums at an axial position of the first groove cooperates with an inner surface of the gas path to define a portion of the outer boundary of the gas path when each drum of the plurality of drums is in the second open position to block fluid communication with the first groove.

11. The fan case assembly of claim 1, wherein the control unit includes at least one actuator coupled to the plurality of drums and configured to drive rotation of the plurality of drums between the closed position, the first open position, and the second open position and a controller coupled to the at least one actuator and configured to direct the at least one actuator to move the plurality of drums to the closed position when the gas turbine engine is in a cruise condition included in the preselected operating conditions.

12. The fan case assembly of claim 11, wherein the control unit further includes a memory coupled to the controller, the memory including a plurality of preprogrammed aircraft maneuvers that each correspond to one of the closed position, the first open position, and the second open position, and wherein the controller is configured to detect a preprogrammed aircraft maneuver included in the plurality of preprogrammed aircraft maneuvers on the memory and direct the at least one actuator to move the plurality of drums to a corresponding position in response to detecting the preprogrammed aircraft maneuver.

13. The fan case assembly of claim 11, wherein the control unit further includes at least one sensor coupled to the controller and configured to measure one of pressure, air speed, altitude, blade tip timing, blade rotational speed, attitude, and acceleration, and wherein the controller is configured to receive a measurement from the at least one sensor and direct the at least one actuator to move the plurality of drums to a corresponding position in response to the measurement of the at least one sensor.

14. A gas turbine engine comprising a fan including a fan rotor configured to rotate about an axis of the gas turbine engine and a plurality of fan blades coupled to the fan rotor for rotation therewith and a fan case assembly adapted for use with a gas turbine engine, the fan case assembly comprising a case that extends circumferentially at least partway about a central axis of the fan case assembly to define an outer boundary of a gas path of the gas turbine engine, the case formed to define a channel that extends circumferentially at least partway about the central axis, a plurality of drums arranged in the channel of the case, each drum of the plurality of drums including a first groove and a second groove spaced apart axially from the first groove that each extend partway into the corresponding drum, each drum of the plurality of drums is configured to rotate about a respective drum axis between a closed position in which both the first groove and the second groove of the corresponding drum each face away from the gas path and an open position in which one of the first groove and the second groove of the corresponding drum faces radially inward towards the gas path while the other of the first groove and the second groove remains facing away from the gas path, and a control unit configured to rotate the plurality of drums about the respective drum axis between the closed position and the open position in response to preselected operating conditions.

15. The fan case assembly of claim 1, wherein the first groove is disposed closer to a first axial end of the drum that the second groove and the second groove is disposed closer to a second axial end of the drum than the first groove, the second axial end opposite from the first axial end.

16. The fan case assembly of claim 14, wherein each drum of the plurality of drums has a cylindrical shape that defines a first end, a second end spaced apart axially from the first end, and an outer surface that extends axially between the first end and the second end and circumferentially about the corresponding drum axis, and wherein the outer surface of each drum of the plurality of drums cooperates with an inner surface of the gas path to define a portion of the outer boundary of the gas path when each drum of the plurality of drums is in the closed position.

17. The gas turbine engine of claim 14, wherein the plurality of drums includes a first set of drums and a second set of drums and the control unit is configured to rotate the first set of drums between the closed position and the open position independent of the second set of drums.

18. The gas turbine engine of claim 17, wherein the first set of drums are alternated circumferentially between the second set of drums.

19. The gas turbine engine of claim 14, wherein the control unit includes at least one actuator coupled to the plurality of drums and configured to drive movement of the plurality of drums between the closed position and the open position and a controller coupled to the at least one actuator and configured to direct the at least one actuator to move the plurality of drums to the closed position when the gas turbine engine is in a cruise condition included in the preselected operating conditions.

20. A method comprising providing a fan case assembly adapted for use with a gas turbine engine, the fan case assembly including a case that extends circumferentially at least partway about a central axis of the gas turbine engine and formed to define an outer boundary of a gas path of the gas turbine engine, the case formed to define a channel that extends circumferentially at least partway about the central axis, and a plurality of drums arranged in the channel, each one of the plurality of drums including a first groove and a second groove that each extend partway into the drum, each drum of the plurality of drums configured to rotate about a respective drum axis, locating the plurality of drums in a closed position in which the first groove and the second groove of the corresponding drum face away from the gas path to cause the outer surface of the corresponding drum to cooperate with an inner surface of the case to define the outer boundary of the gas path, and rotating the plurality of drums to an open position in which one of the first groove and the second groove of the corresponding drum faces radially inward towards the gas path while the other of the first groove and the second groove faces away from the gas path.

* * * * *